US008756940B2

(12) United States Patent
Doucet et al.

(10) Patent No.: US 8,756,940 B2
(45) Date of Patent: Jun. 24, 2014

(54) COMPARTMENTED TEMPERATURE AND HUMIDITY CONTROLLED MODULAR HOUSING FOR THE STORAGE AND PRESERVATION OF WINE BOTTLES

(75) Inventors: Guy Doucet, Québec (CA); Laurent Senee, Jonquière (CA)

(73) Assignee: Intelligent Cellars Inc., Québec (CA)

( * ) Notice: Subject to any disclaimer, the term of this patent is extended or adjusted under 35 U.S.C. 154(b) by 576 days.

(21) Appl. No.: 12/977,176

(22) Filed: Dec. 23, 2010

(65) Prior Publication Data

US 2012/0159968 A1 Jun. 28, 2012

(51) Int. Cl.
*F25B 21/02* (2006.01)

(52) U.S. Cl.
USPC ..... 62/3.6; 62/465; 62/246; 62/264; 62/407; 62/157; 62/457.8

(58) Field of Classification Search
USPC ..... 62/457.8, 465, 466, 462, 437, 246, 247, 62/3.6, 3.4, 248, 457.1, 457.5, 249, 407; 221/286, 150 R; 312/36, 291, 351.1, 312/351.9; 220/516, 521, 509; 206/545, 206/427; 248/102, 103, 111, 311.3, 312, 248/312.1; 211/94.01, 85.29, 74
See application file for complete search history.

(56) References Cited

U.S. PATENT DOCUMENTS

| | | | | |
|---|---|---|---|---|
| 3,500,649 | A | 5/1968 | Feldman | |
| 4,239,153 | A * | 12/1980 | Monigold et al. | 236/86 |
| 4,870,837 | A * | 10/1989 | Weins | 62/457.4 |
| 6,308,519 | B1 | 10/2001 | Bielinski | |
| 7,178,343 | B2 * | 2/2007 | Linder | 62/3.6 |
| 7,240,889 | B2 * | 7/2007 | Giovinazzi | 248/501 |
| 7,254,952 | B2 * | 8/2007 | Lilke | 62/3.6 |
| 7,857,473 | B2 * | 12/2010 | Shibusawa et al. | 362/92 |
| 2002/0088457 | A1 * | 7/2002 | McDonald | 126/512 |
| 2006/0021513 | A1 | 2/2006 | Ide | |
| 2006/0110657 | A1 * | 5/2006 | Stanton et al. | 429/120 |
| 2008/0308508 | A1 * | 12/2008 | Fischer | 211/2 |
| 2009/0173093 | A1 * | 7/2009 | Sueda et al. | 62/157 |
| 2009/0173101 | A1 * | 7/2009 | Hynes | 62/441 |
| 2009/0218365 | A1 * | 9/2009 | Taradalsky et al. | 222/1 |
| 2009/0230131 | A1 * | 9/2009 | McDuffie et al. | 220/495.06 |

FOREIGN PATENT DOCUMENTS

| | | | |
|---|---|---|---|
| JP | 2002-372356 | A | 6/2001 |
| WO | WO 02/055945 | A1 | 7/2002 |

* cited by examiner

*Primary Examiner* — Cheryl J Tyler
*Assistant Examiner* — Ana Vazquez
(74) *Attorney, Agent, or Firm* — Norton Rose Fulbright Canada LLP; Alexandre Dacust

(57) ABSTRACT

A temperature and humidity controlled housing for storing and preserving wine bottles. The housing defines a storage compartment having front and rear temperature control chambers and wherein the rear chamber is also humidity controlled. A division wall having passages provided with a flexible sealing component receives bottles on supports associated with each of the passages and a cubic chamber structure in the rear chamber. The bottle necks engage the seals which, together with the division wall, substantially seal the front chamber from the rear chamber while the spout end portion of the wine bottles is supported in the rear humidified chamber. The housing may be used in a modular assembly. The method of use is also described.

29 Claims, 22 Drawing Sheets

COMPARTMENTED TEMPERATURE AND HUMIDITY CONTROLLED MODULAR HOUSING FOR THE STORAGE AND PRESERVATION OF WINE BOTTLES

TECHNICAL FIELD

The present invention relates to a compartmented temperature and humidity controlled modular housing for the storage and preservation of wine bottles and method of preservation.

BACKGROUND ART

Many types of refrigerated cellars and cabinets are known for the storage of wine bottles. A most common and popular type is constituted by small refrigerated housings capable of storing from 12 to 100 bottles and wherein these refrigerated housings can be incorporated into kitchen counters, liquor bars and any other convenient locations. These small refrigerated housings are usually refrigerated by gas refrigeration systems utilizing a compressor. Compressors are known to generate noise, heat and vibrate subjecting the wine bottles to these unwanted elements and causing damage to the quality of the wine contained within the bottles. Also, these refrigerated housings usually have a glass door which is exposed to exterior light, or have incorporated therein a light source, the wave length of which causes damage to the wine within the bottles and particularly clear glass bottles. A further disadvantage of such wine cabinets and large collectors' cellars is that when the wine is stored for long periods of time, the corks in such wine bottles dry-up if the bottle is not properly stored, often causing air ingress into the bottle and damaging the quality of the wine. Improper lighting of collector cellars is also damaging to the wine particularly if the bottles are transversely disposed to light rays.

Concerning the effects of light on wine various studies have been conducted and these have revealed that ultra violet rays, having wave lengths below 400 nm, are damaging to wine, and therefore have an effect on the conservation and the taste of the wine. It can have an impact which is worst than maintaining wine in a hot environment. Such undesirable light causes a chemical reaction on various chemicals contained in the wine such as cystine and amino acids which contain sulfur. Light also has an effect on the riboflavin (vitamin B2) or on the vitamin B5 acids and such effects can be tasted on the palette. It is also known that red wines are much better protected than white wine and less susceptible to damage by light.

It is also known that in old wine cellars where "grand-cru" and other vintage wines are stored only candlelight is permitted as a means of lighting. The intensity of the light is also damaging to wine. This is why wine cellars which store "grand-cru" are lit by very low intensity lighting. By experimentation using wine tasters it has been found that the best quality of wine is that which has been stored in wine cellars having reddish ambient lighting and a certain degree of humidity to prevent the corks from drying.

We have discovered that the best light generating sources for cellars are light emitting diodes (LEDs) which can project light in a specific direction. By aligning the LED light rays with the longitudinal axis of the bottles the incident red light generated by these LEDs has no effect on the wine as most of the light rays are reflected by the bottles. However, reflecting light in a substantially transverse manner would have more effect on the wine contained within the bottles. The thickness of the glass of the wine bottle also has an influence on the percentage of light transmitted therethrough.

Another disadvantage of light utilizing incandescent lighting sources is that they generate heat. The more heat generated by the light source the more capacity is transmitted to the refrigeration system. LEDs are the best known sources that generate less heat. They are also compact and utilize very little space. They also have a very long life span from between 20,000 to 50,000 hours requiring little maintenance and utilize very little energy.

It should also be noted that white wines can be damaged quickly by ultraviolet light rays below 400 nm which wines are affected in approximately 3 hours although a red wine, subject to the same lighting, would require 200 hours to be affected by the light.

SUMMARY OF INVENTION

It is a feature of the present invention to provide a temperature and humidity controlled housing for storing and preserving wine bottles which substantially overcomes the above-mentioned disadvantage of the prior art.

Another feature of the present invention is to provide a temperature and humidity controlled housing for storing and preserving wine bottles and wherein the housing is divided into two chambers, one being a temperature and humidity controlled chamber where the neck and spout end portion of the bottle is positioned and the other being a temperature control chamber where the body portion of the bottle is supported.

Another feature of the present invention is to provide a temperature and humidity controlled housing for storing and preserving wine bottles and wherein the housing is comprised of light sources which generate red light rays above 400 nm with the light rays oriented such as not to affect the quality of wine preserved in the wine bottles.

Another feature of the present invention is to provide a temperature and humidity controlled housing for storing and preserving wine bottles and wherein the housing is mounted in a vibration absorbing frame.

Another feature of the present invention is to provide a temperature and humidity controlled housing for storing and preserving wine bottles and wherein the housing is refrigerated by thermoelectric refrigerating devices and the spout ends of the bottles are situated in a controlled humidified chamber.

Another feature of the present invention is to provide a temperature and humidity controlled housing for storing and preserving wine bottles and wherein the housings with frame are of modular construction and can be assembled with a plurality of other housings and wherein the housings are independently controlled from one another.

Another feature of the present invention is to provide a temperature and humidity controlled housing for storing and preserving wine bottles and wherein a controlled device incorporating a microprocessor automatically controls the temperature and humidity in the chambers of the housing.

Another feature of the present invention is to provide a temperature and humidity controlled housing for storing and preserving wine bottles and which incorporates a programmable control means providing the user person with means to input information and accessing means to access stored information pertaining to the wine bottles stored in the housing and other parameters.

Another feature of the present invention is to provide a temperature and humidity controlled housing for storing and preserving wine bottles and wherein individual bottle supports are provided for locating and supporting bottles of different configurations through a division wall of the housing and in substantially sealing engagement with the division wall to isolate the front and rear chambers from one another.

A further feature of the present invention is to provide a method of preserving wine bottles in a temperature and humidity controlled housing.

According the above features, from a broad aspect, the present invention provides a temperature and humidity controlled housing for storing and preserving wine bottles. The housing has a storage compartment for supporting a plurality of wine bottles. A division wall is provided in the storage compartment defining a front and a rear chamber. The housing has a door for access to the front chamber for positioning and retrieving wine bottles from individual bottle supports. The bottle supports are secured in relation to an associated one of a plurality of passages formed with the division wall whereby a neck and spout end portion of the wine bottles extend into the rear chamber and a body portion of the wine bottles extends supported in the front chamber. Refrigeration means is provided to refrigerate the storage compartment. The rear chamber has a humidity control means whereby the spout end of the bottle is maintained in a humidified environment.

According to a further broad aspect of the present invention there is provided a method of preserving wine bottles in a temperature and humidity controlled housing. The method comprises providing a housing defining a storage compartment for supporting a plurality of wine bottles at a specific orientation. The housing is divided by a division wall to define a refrigerated front chamber and refrigerated and humidified rear chamber. The division wall has a plurality of passages. Bottle supports are secured in relation to an associated one of the passages. The method further comprises positioning wine bottles on the bottle supports by pushing a neck and spout end portion of the wine bottles into the rear chamber through the passages to establish a substantially sealed relationship between the neck and spout end portion and the passages of the division wall.

BRIEF DESCRIPTION OF DRAWINGS

A preferred embodiment of the present invention will now be described with reference to the accompanying drawings in which:

FIG. 1D is a fragmented view showing the orientation of a wine bottle supported in the housing;

FIG. 2B is a rear perspective view of FIG. 2A;

DESCRIPTION OF PREFERRED EMBODIMENTS

Figure 1A:
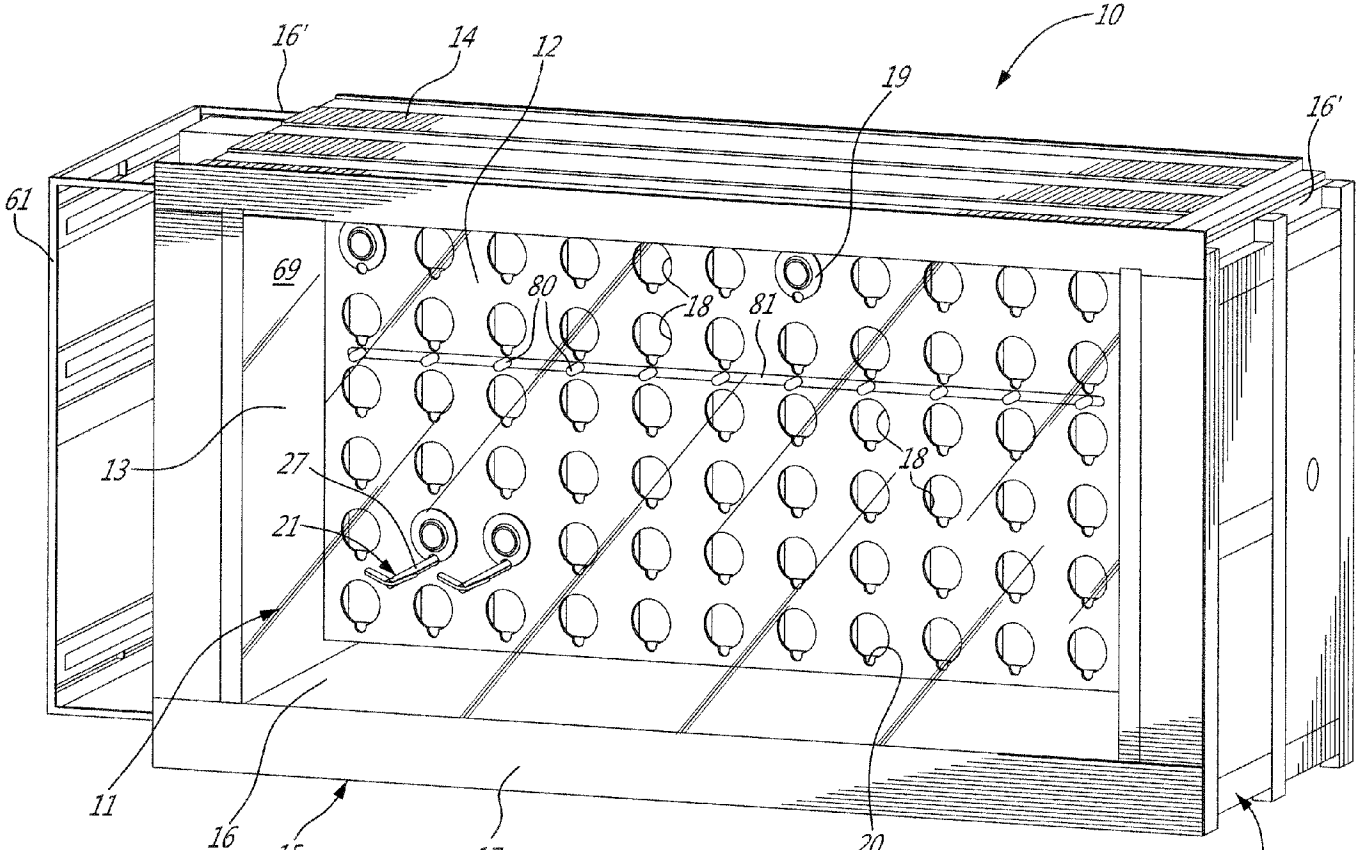
FIG. 1A is a perspective view of a partly assembled temperature and humidity controlled housing constructed in accordance with the present invention.
Figure 1B:
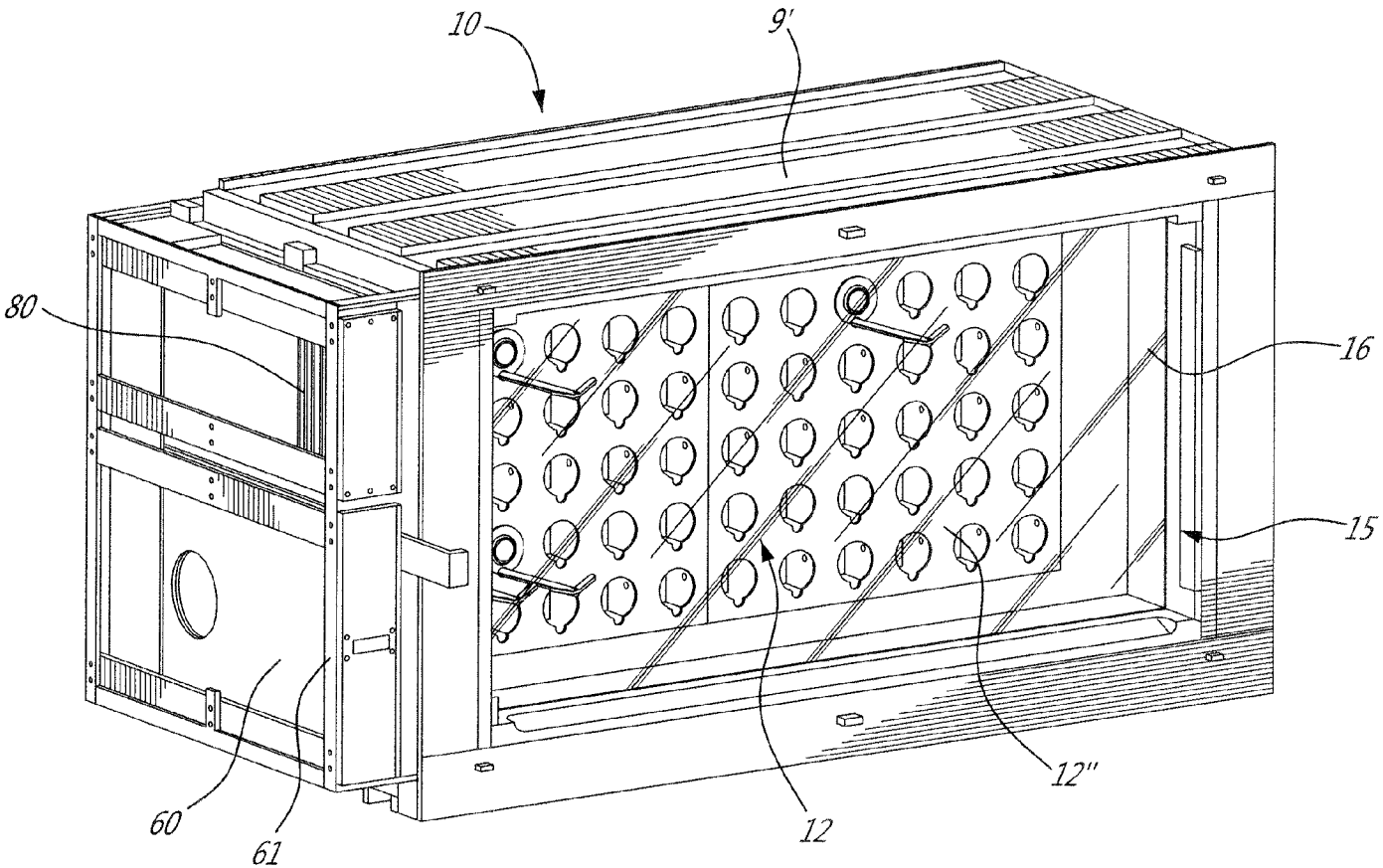
FIG. 1B is a further perspective view similar to FIG. 1A, and showing further component parts assembled with the support frame.
Figure 1C:
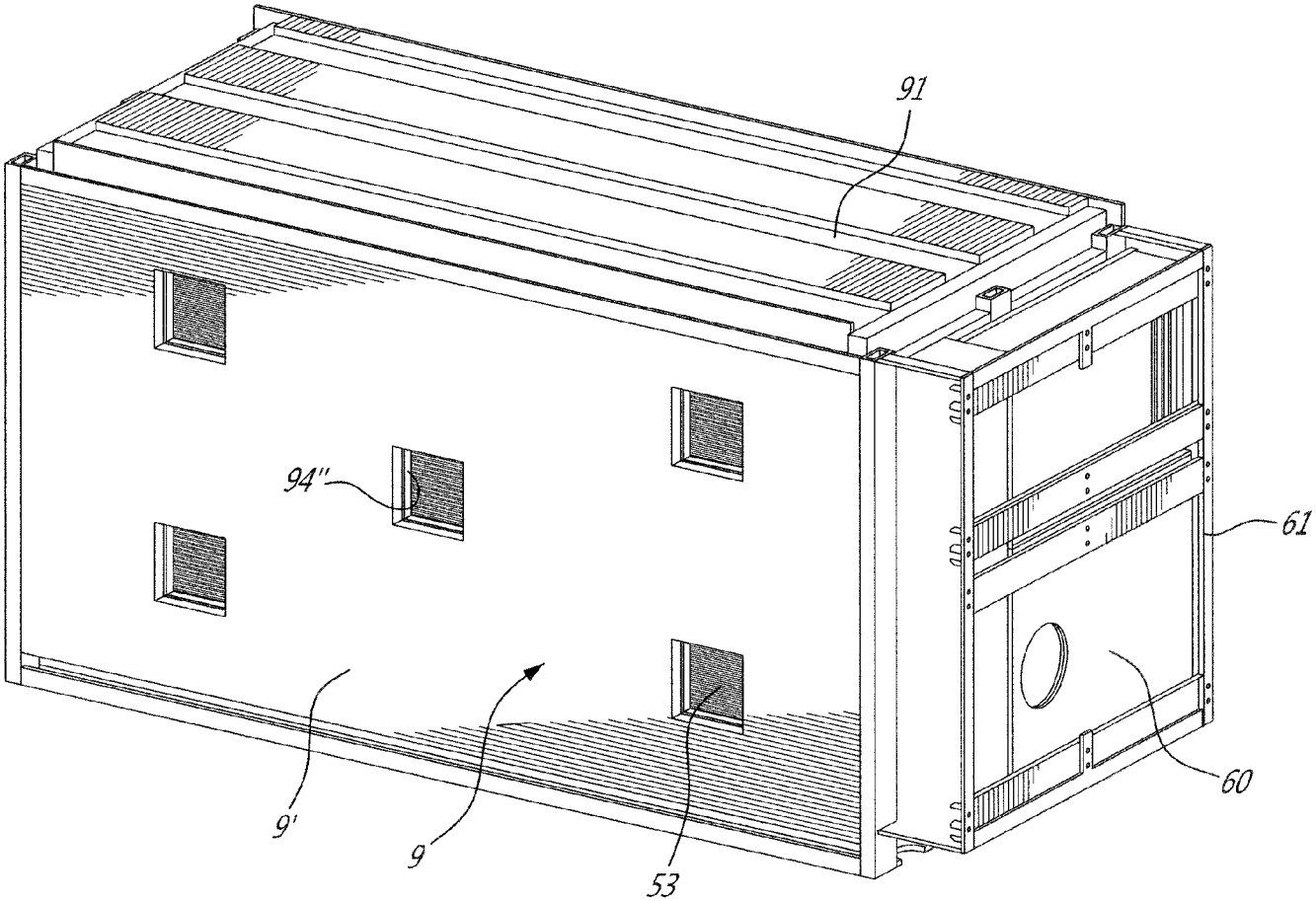
FIG. 1C is a rear perspective view of FIG. 1B.
Figure 10:
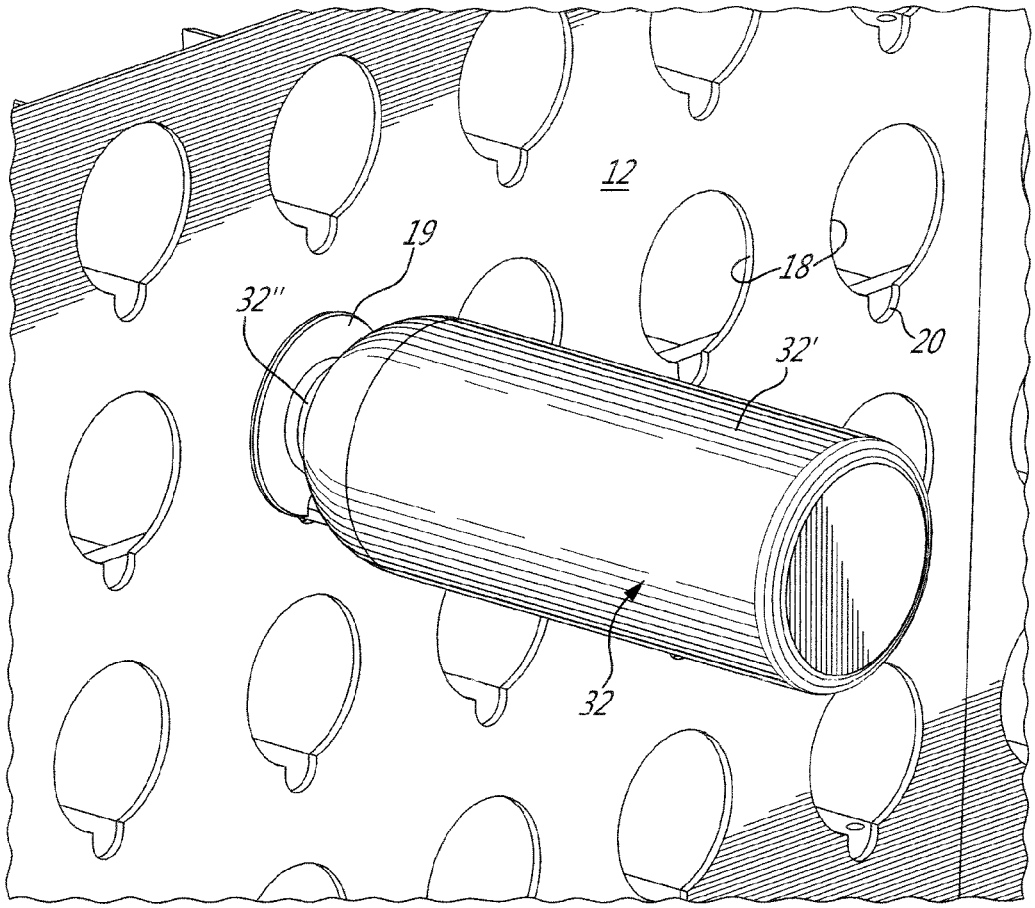

Referring now to the drawings, and more particularly to FIGS. 1A to 1E, there is shown a perspective view of a partly constructed temperature and humidity controlled housing 10 constructed in accordance with the present invention and for the storage and preservation of wine bottles. The housing 10 has a storage compartment 11 for storing a plurality of wine bottles 32 (see FIG. 1D) in a specific orientation as will be described later. The housing is provided with a division wall 12 which defines a front chamber 13, in front of the division wall 12, and a rear chamber 14, behind the division wall. A door 15 incorporating a double glass pane 16 and door frame 17 is appropriately hingedly secured to the housing to provide access to the interior thereof and the front chamber 13. The housing has an insulating rear wall 9 as shown in FIG. 1C. A light damping film is sandwiched between the double glass panes 16.

As can be seen from FIGS. 1A to 1E, the division wall 12 is provided with a plurality of circular passages 18 in which is secured a flexible circumferential sealing membrane 19, as shown in FIG. 1B, to create a seal about the bottles 32 as will be described later. Each of the circular passages 18 has a small curved alignment cavity 20 in a lower edge portion thereof disposed on a vertical radius of the circular passages 18. This curved alignment cavity is provided to support a straight support rod 22 of a bottle support 21. Bottles are positioned on the bottle supports and pushed through the annular seals 19 and when the housing is entirely filled with bottles the front chamber 13 becomes sealed from the rear chamber 14 due to the annular seals provided in the circular passages 18 and sealingly engaging the neck portion of the bottles. When bottles are not positioned on the supports 21 and through the annular seals 19, a displaceable closure means in the form of a hinge door (see FIG. 2C) substantially seals the circular passage 18 by being spring-biased against the rear face 12' of the division wall 12 by a torsion spring 8'. The hinge door 8 is pushed open in the direction of arrow 8" when a bottle spout end and neck portion is pushed through the circular passage 18.

Figure 1E:
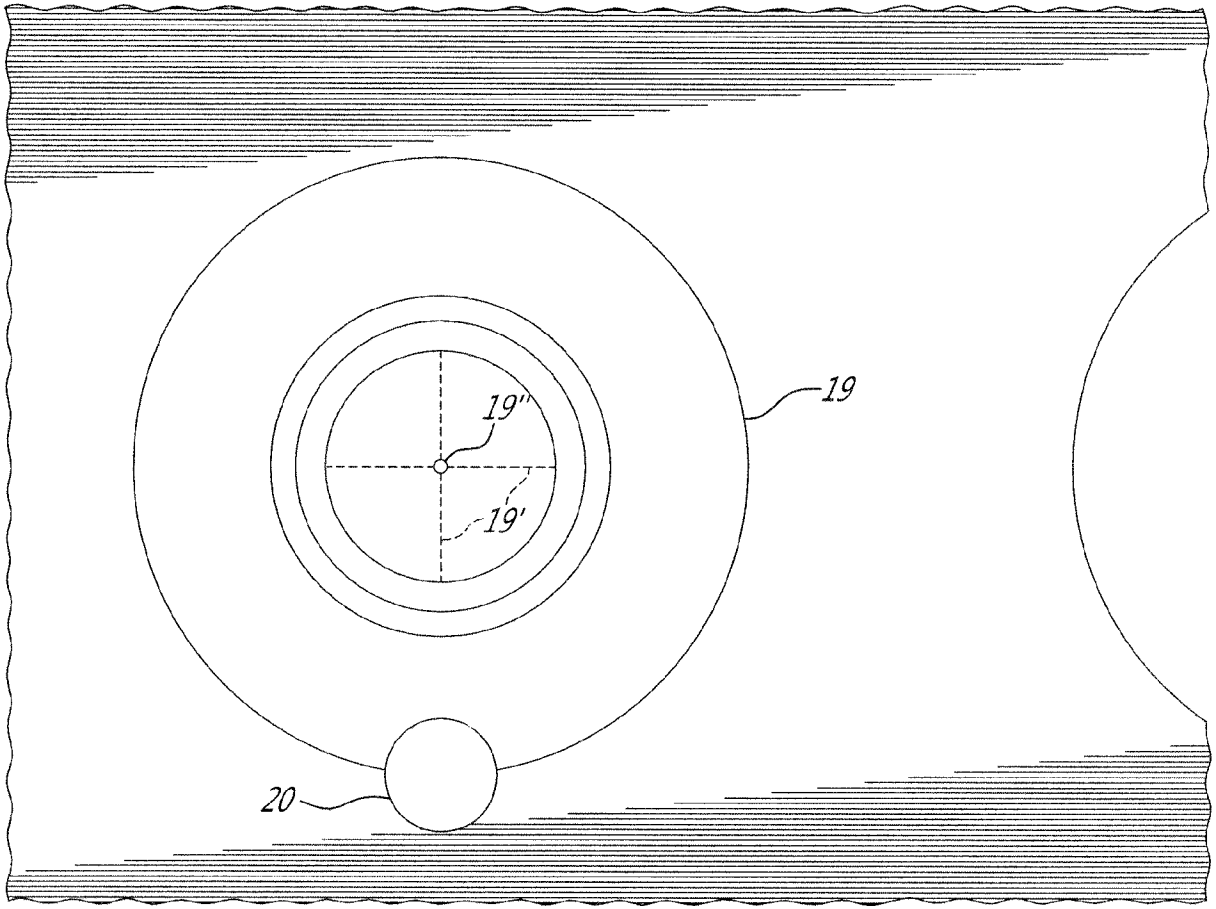
FIG. 1E is a front view of the flexible annular seal secured in the passages.

Referring to FIG. 1E, there is illustrated another embodiment of the annular seal 19 and as thereinshown in phantom lines the seal 19 may be formed as a circular disc membrane provided with slits, herein cross slits 19' radiating from a center point 19" thereof and constituting flexible tongue portions 19'" adapted to be displaced inwardly from the front face 12" of the division wall 12 when the spout end and neck portion of the wine bottle 32 is pushed therethrough. Accordingly, this circular disc would replace the hinge door 8 and constitute a displaceable closure means.

Figure 2A:
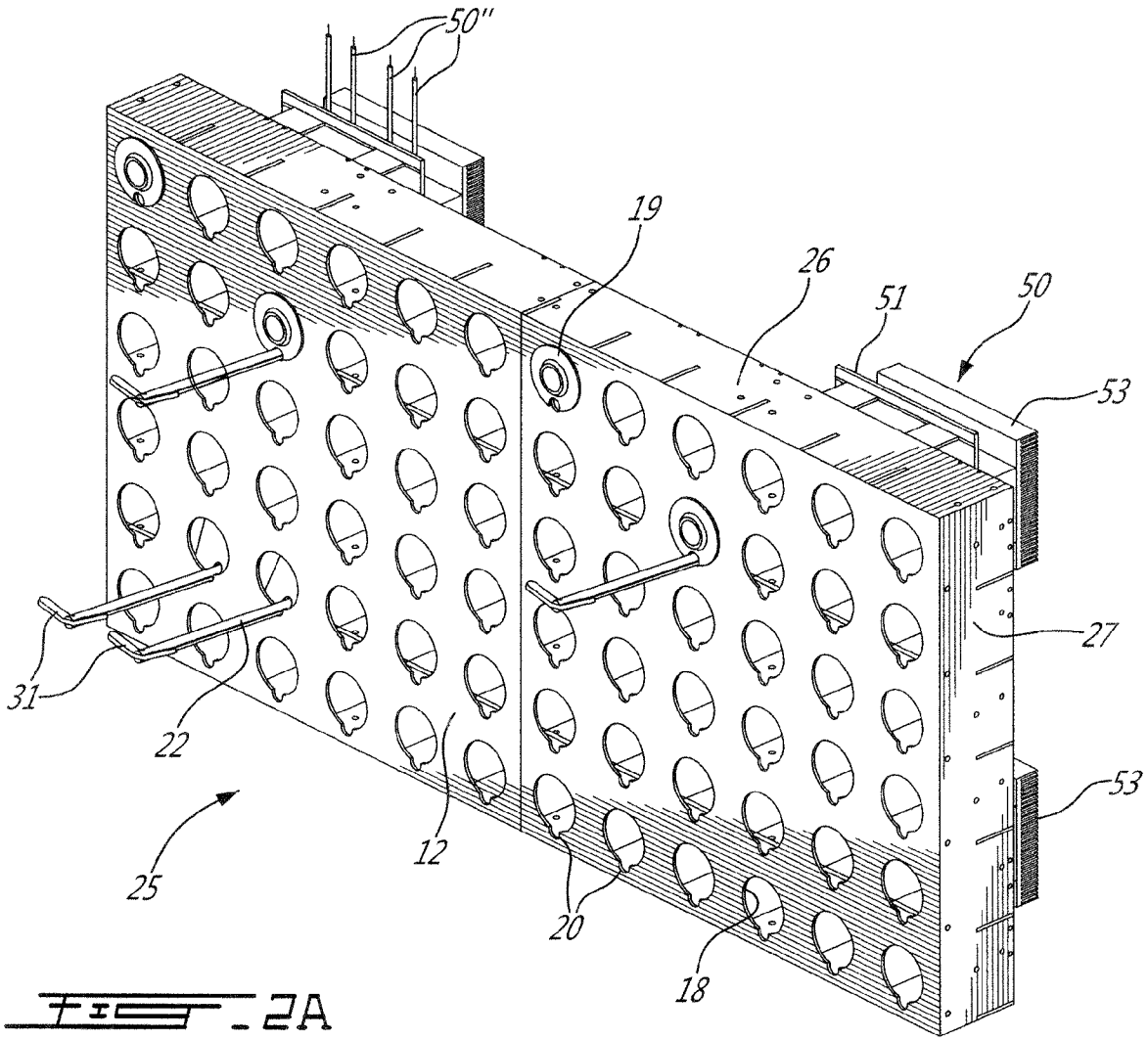
FIG. 2A is a front view of the cubic chamber structure which is located behind the division wall of the housing and wherein a plurality of thermoelectric refrigeration devices are secured thereto to refrigerate the cubic chamber structure and produce a humid environment about the neck and spout end portion of the wine bottles.
Figure 28:
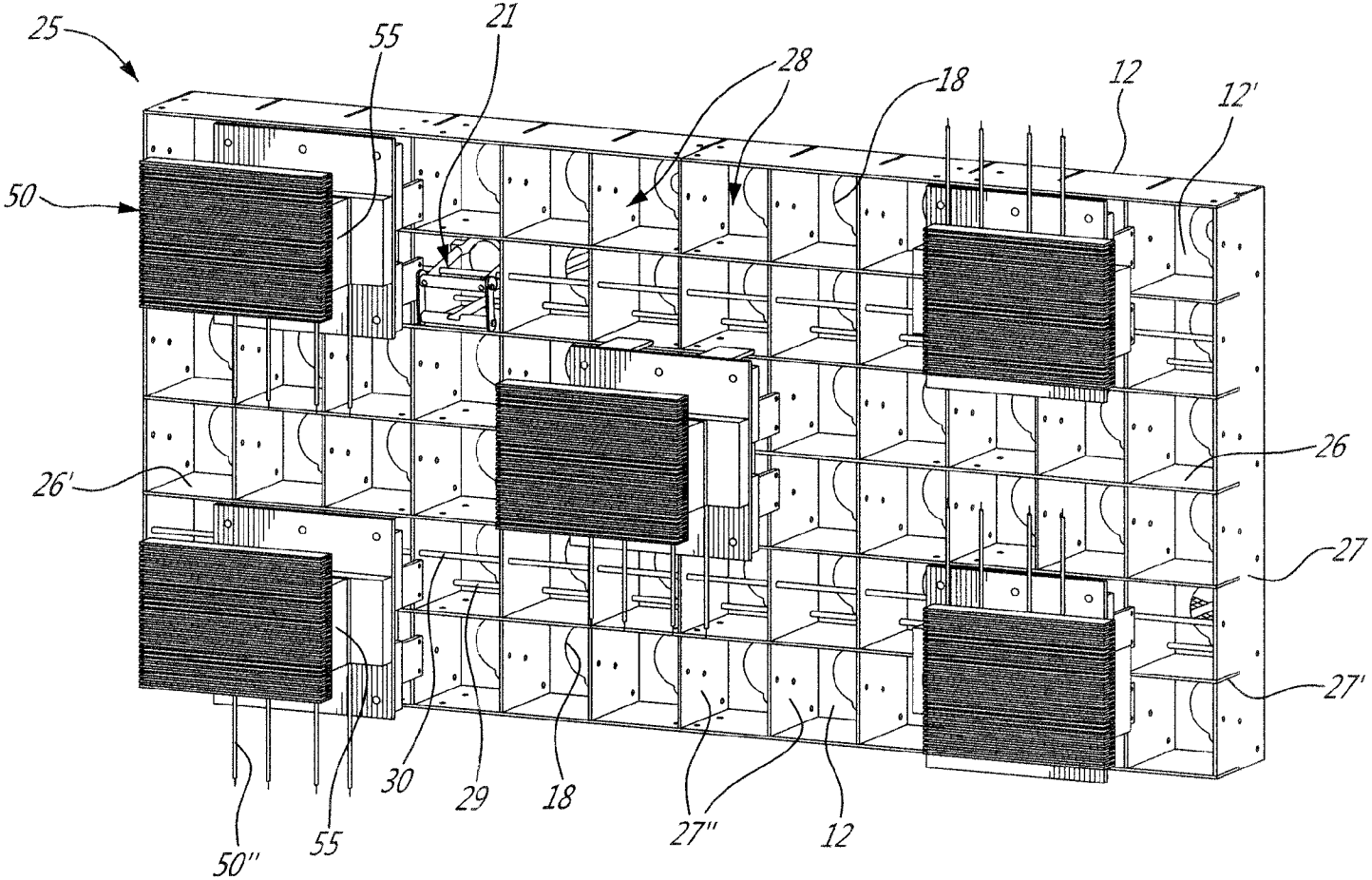
Figure 2C:
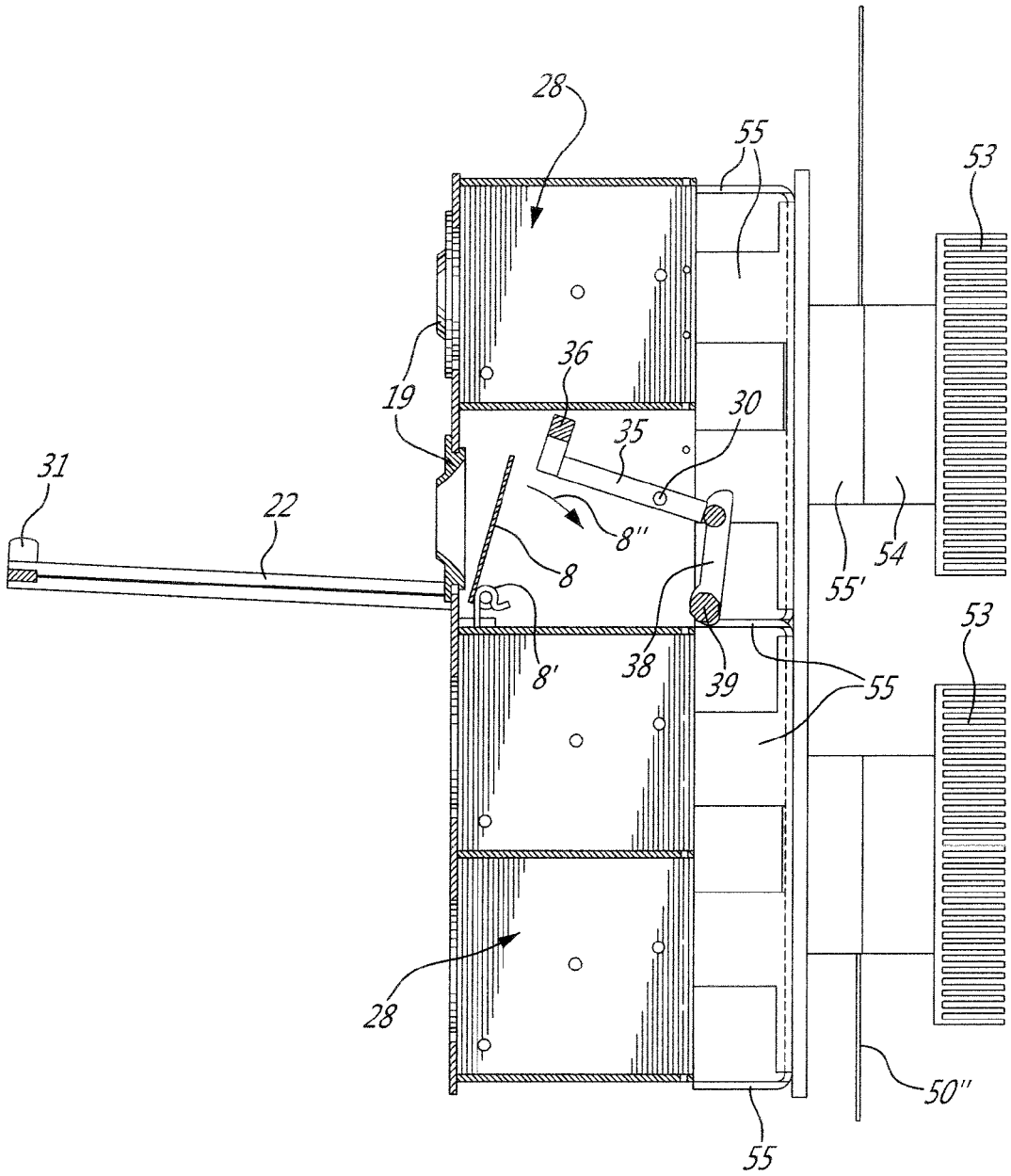
FIG. 2C is an enlarged cross-section view, partly fragmented, showing the securement of the bottle supports with respect to the cubic chamber structures.

Referring now to FIGS. 2A to 2C, there is shown the construction of a cubic chamber structure 25 secured to the division wall 12. The cubic chamber structure 25 is secured in contact with the rear face 12' of the division wall 12 as hereinshown. The cubic chamber structure 25 is formed by interconnected spaced-apart horizontal and vertical metal plates 26 and 27, each provided with slots 26' and 27' for meshing engagement therebetween to define a plurality of cubic chambers 28 which have an open rear end. Each cubic chamber 28 is associated with a respective one of the plurality of circular passages 18, as clearly shown in FIGS. 2A to 2C. The passages 18 are aligned horizontally and vertically.

As shown in FIGS. 2A to 2C, individual bottle supports 21 are secured to associated ones of the cubic chambers 28, only one bottle support 21 being shown in FIG. 2C for ease of illustration.

Referring additionally to FIGS. 3A to 4D, there is shown the construction of the bottle supports 21. These bottle supports 21 are secured to two pivot rods, namely a support pivot rod 29 and an actuable lever pivot rod 30. The pivot rods 30 and 29 are secured across the opposed vertical walls 27" of each cubic chamber 28 and such are illustrated in FIG. 2B. As can be seen these rods 29 and 30 extend in parallel relationship to one another and are offset from one another.

Figure 3A:
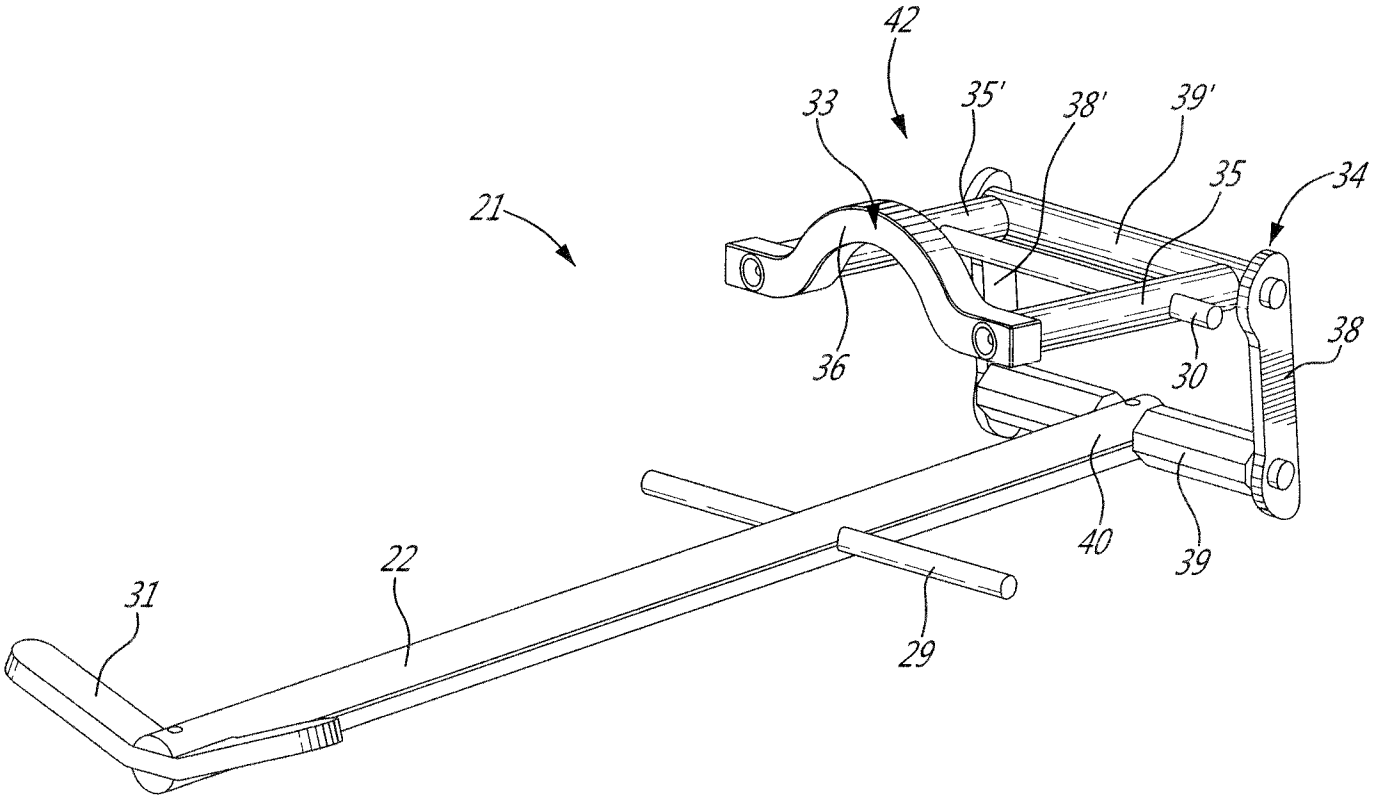
FIG. 3A is a perspective view showing the construction of the bottle supports.
Figure 3B:
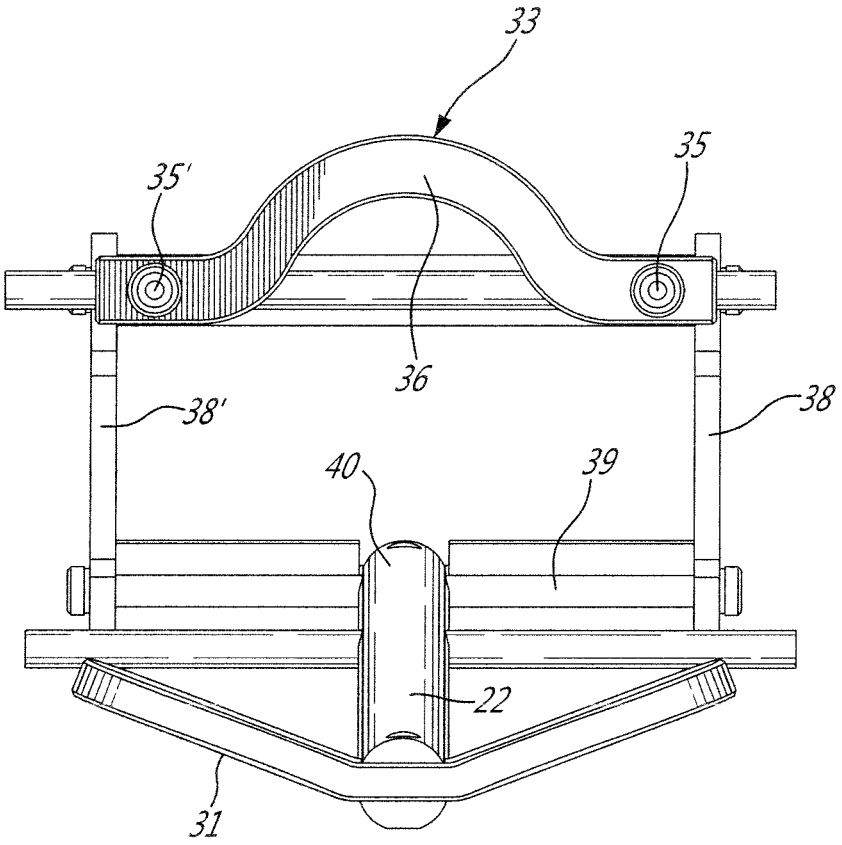
FIG. 3B is an enlarged view of a bottle support as seen from the front access chamber.
Figure 4A:
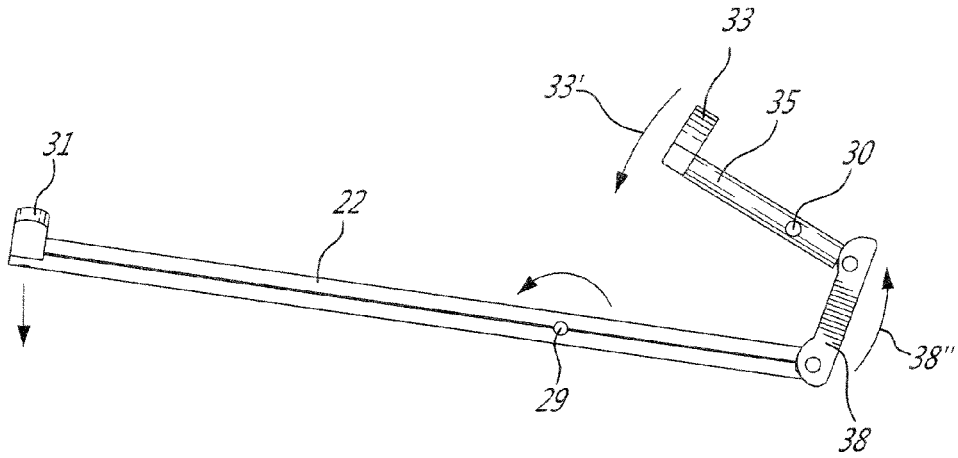
FIG. 4A is a side view of the bottle support showing its position prior to receiving a wine bottle thereon with its actuable linkage in an open unengaged position and illustrating the action thereof for engagement.
Figure 4B:
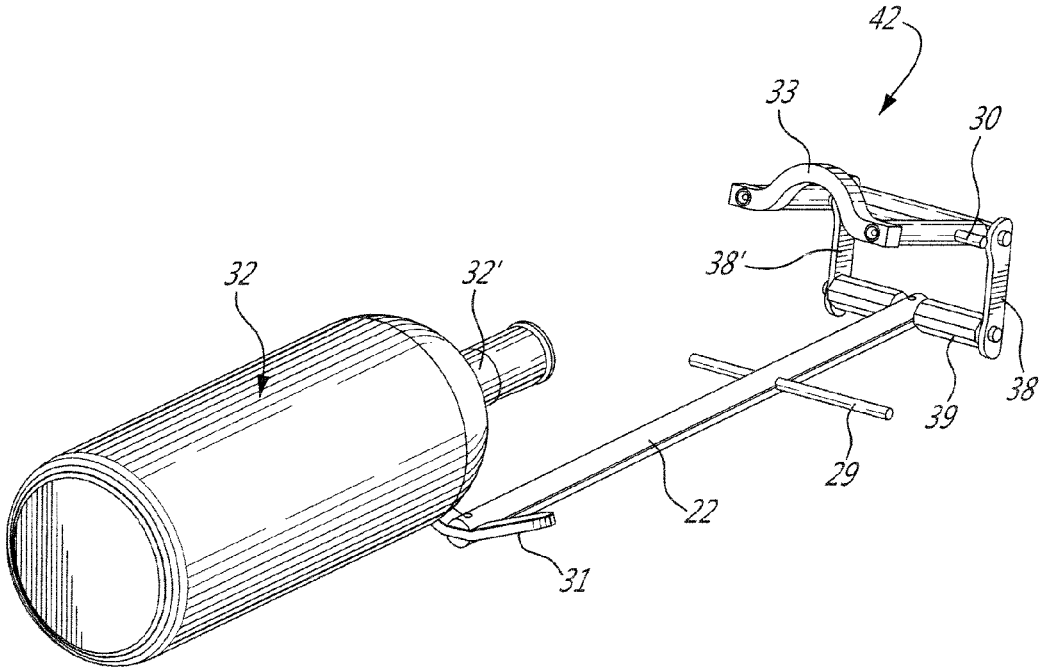
FIG. 4B is a perspective view showing the orientation of a wine bottle being positioned on the bottle support.
Figure 4C:
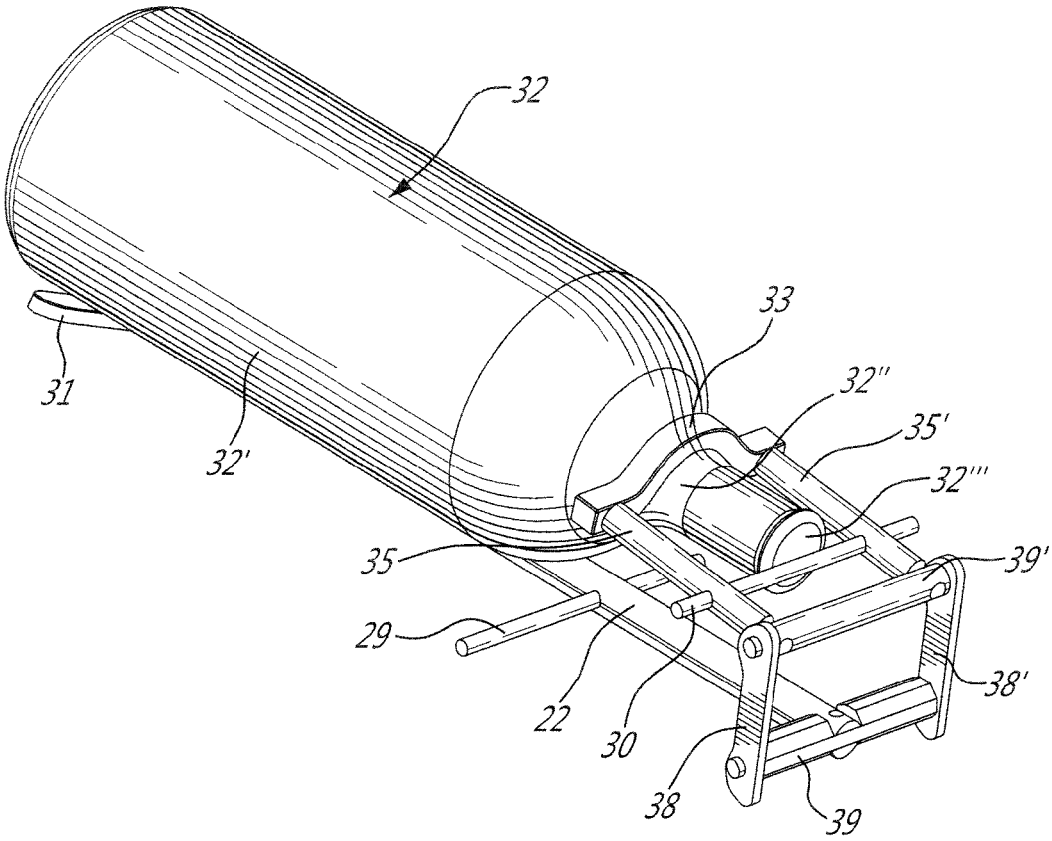
FIG. 4C is a perspective view showing the wine bottle disposed on the bottle support and the actuable linkage in an engaged position with the neck of the bottle.
Figure 4D:
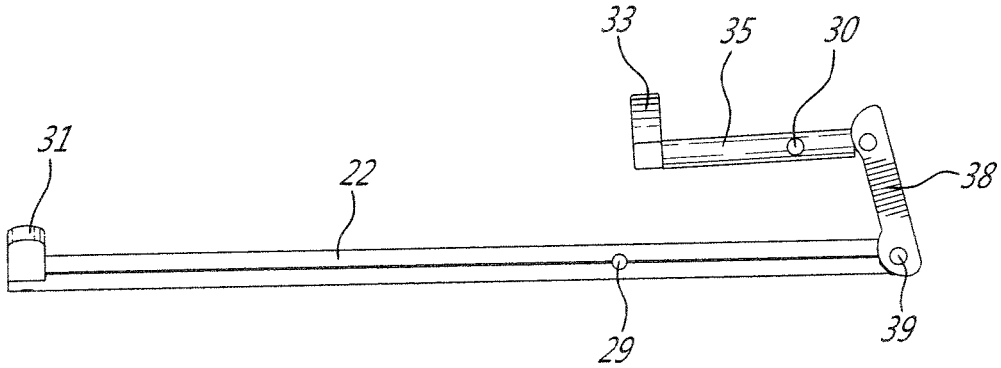
FIG. 4D shows the actuable linkage in an engaged position.

As shown in FIGS. 3A and 3B, each bottle support is constituted by a straight support rod 22 having a bottle seating member 31 at a free end thereof for supporting the body portion 32' of a bottle 32 positioned thereon, as shown in FIG. 4C. An actuable pivoting linkage assembly 42 is secured to a counter-lever opposed end 40 of the straight support rod 22 and it has a bottle neck clamping lever 33 which is connected to an actuable linkage 34 to translate an upward pushing force, in the direction of arrow 38' applied by the weight of the wine bottle 32 inserted and pushed through an associated passage of the bottle support 21. The pushing force 38' causes the clamping lever 33 to move downward in the direction of arrow 33.

The bottle neck actuable lever 33 is comprised of a pair of pivoting spaced-apart side arms 35 and 35' pivotally secured to the fixed horizontal pivot rod 30. The bottle neck actuable lever 33 also has a curved arch member 36 which is secured between opposed forward ends of the side arms 35 and 35' for frictional clamping engagement over the neck portion 32" of the bottle 32, as shown in FIG. 4C to retain the bottle in a horizontal position. When the bottle is retrieved, the weight of the pivoting linkage assembly 42 causes the support rod 22 to slightly pivot causing the clamping lever 33 to move upward to its position as shown in FIG. 4A. Linkage arms 38 and 38' are pivotally connected to one another at a top end by a pivot rod 39' and at a bottom end by a further pivot rod 39. The opposed rear ends of the side arms 35 and 35' are secured to the horizontal pivot rod 39' to actuate the clamping lever 33. The linkage arms 38 and 38' are pivotally connected at a lower bottom end thereof to a respective end of a transverse attachment arm 39 secured to the counter lever end 40 of the straight support rod 22. The transverse attachment arm 39 extends parallel to the pivot rods 29 and 30.

As shown in FIGS. 4B and 4C, when a bottle 32 is pushed through the annular seal and the hinge door 8 associated with the circular passages 18, the neck portion 32' of the bottle is disposed under the actual lever 33 and the weight of the bottle causes the linkage arms 38 to move slightly downwards in the direction of arrow 38" to clamp the bottle neck to assure that the cork, as hereinshown in phantom line at 32'", is maintained in contact with the wine within the bottle.

Figure 5:
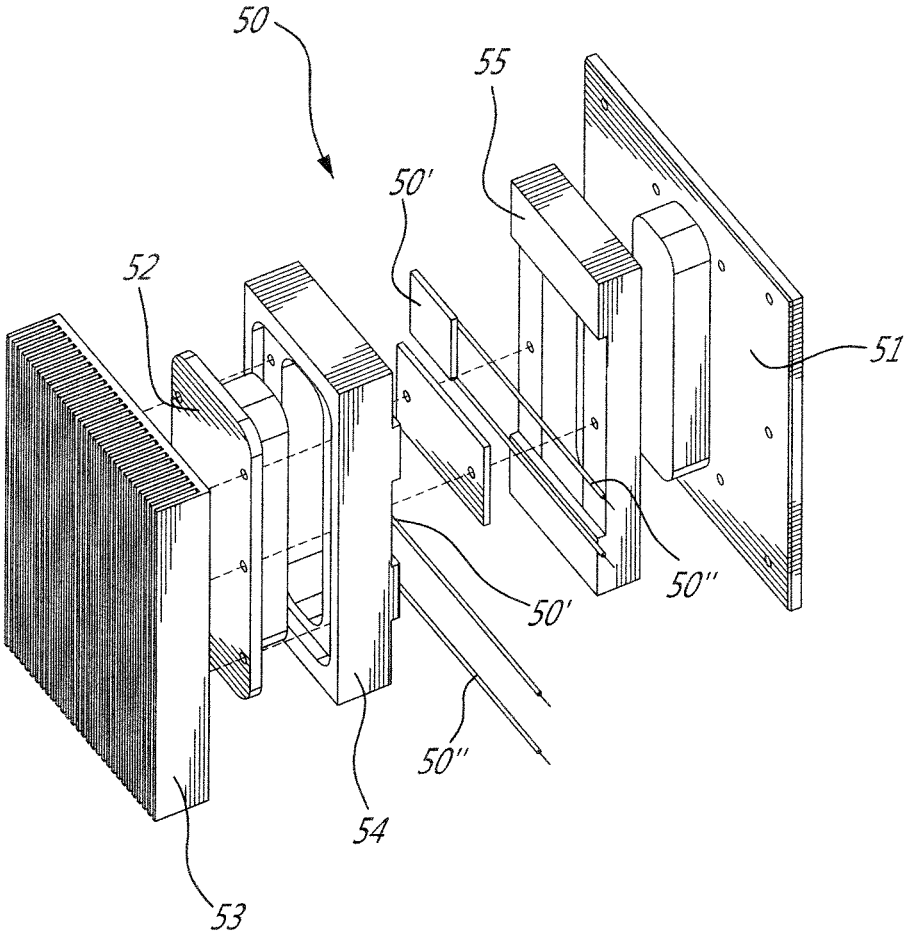
FIG. 5 is an exploded perspective view showing the construction of a thermoelectric heating device constructed in accordance with the present invention.

Referring again to FIGS. 2B, 2C and FIG. 5, there is shown the construction and disposition of the refrigerating device herein constituted by thermoelectric refrigeration module 50. As is well known in the art, these modules are comprised of semi-conductors 50' formed of N-P conductors sandwiched between a pair of thermally conductive plates 51 and 52. When current flows in the N-P conductors via their leads 50", the Pelletier effect takes place and one side of the semiconductor produces heat and the opposite side produces cold. The cold plate 51 is in contact with the cold side of the thermoelectric module 50 and the hot plate 52 in contact with the hot side. A heat sink 53 is secured to the hot plate to dissipate heat outside the housing. Composite insulating material components 54 and 55' isolate the hot plate from the cold plate.

As shown in FIG. 2B, there are five thermoelectric refrigeration modules 50 secured to the cubic chamber structure 25 behind the open rear end thereof whereby the cold plates 51 of the thermoelectric refrigeration modules 50 will refrigerate the horizontal and vertical plates 26 and 27 of the cubic chamber structures and which plates are constructed of thermally conductive metal. These plates will accumulate the cold generated by the cold air which is defused into the cubic chamber structure behind the division wall and cool the division wall 12 and the front chamber 13. The rear wall 9 of the housing 10 is formed of insulating foam sheets 9' configured about the composite material component 54 with the heat sink 53 located in cavities 9" to be exposed to ambient air. Accordingly, heat generated by the hot plate is dissipated outside the housing (see FIG. 1C). A small air blower or fan (not shown) could also be mounted behind the housing and secured to an independent support frame to evacuate heat generated by the heat sinks 53.

Figure 6A:
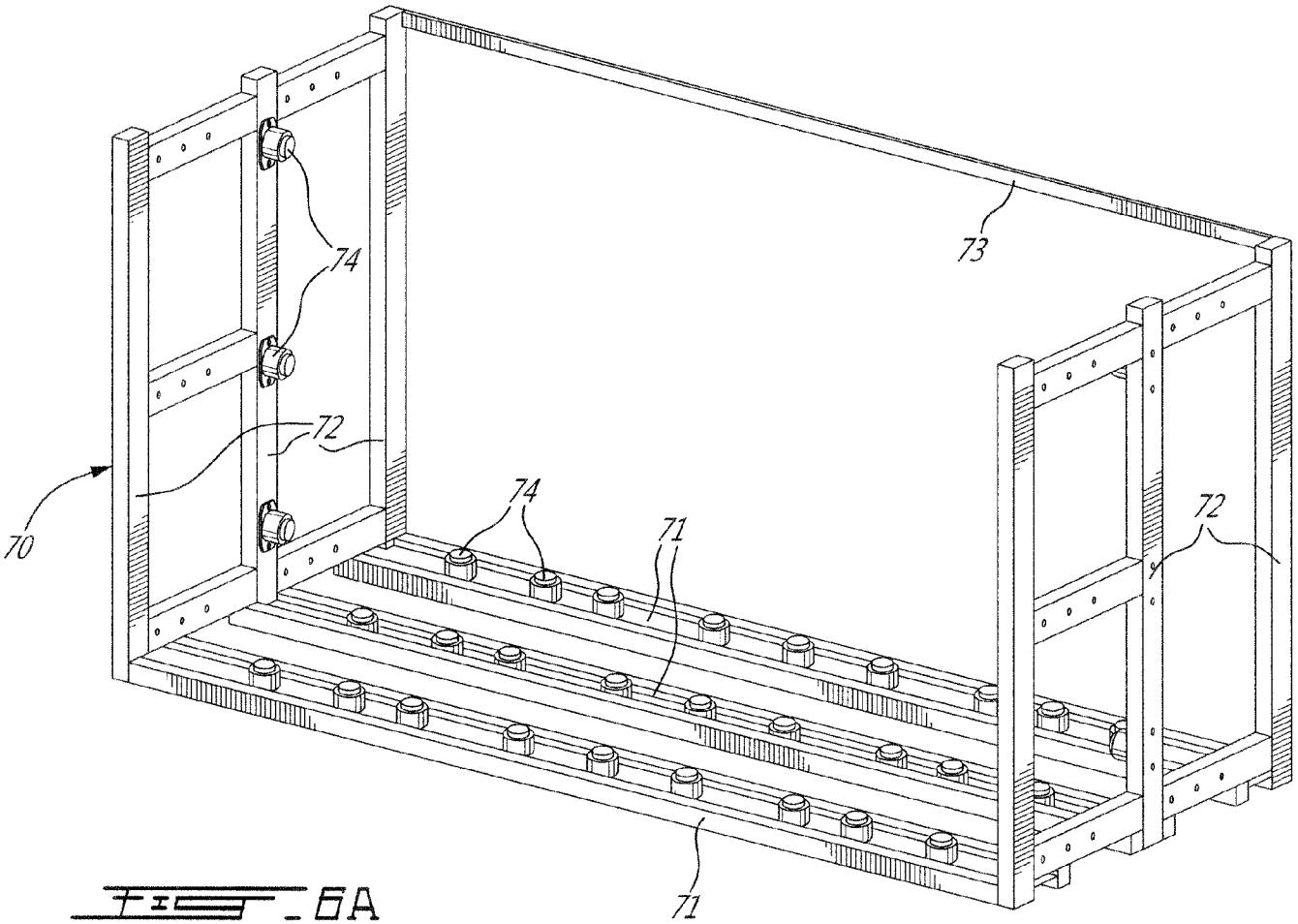
FIG. 6A is a perspective view of the vibration damping frame.
Figure 6B:
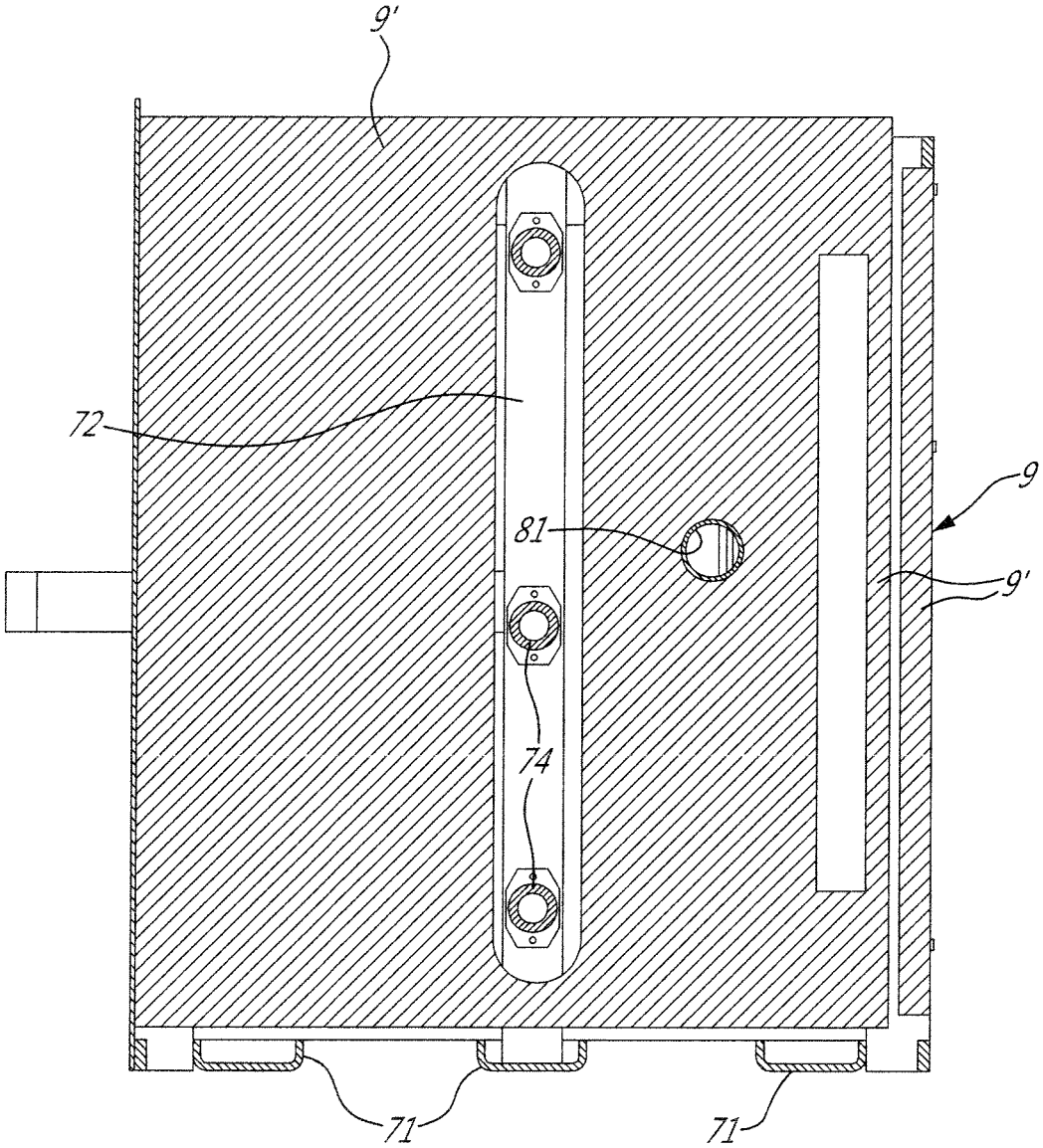
FIG. 6B is a side view of the housing mounted in the vibration damping frame with insulation secured thereto.
Figure 6C:
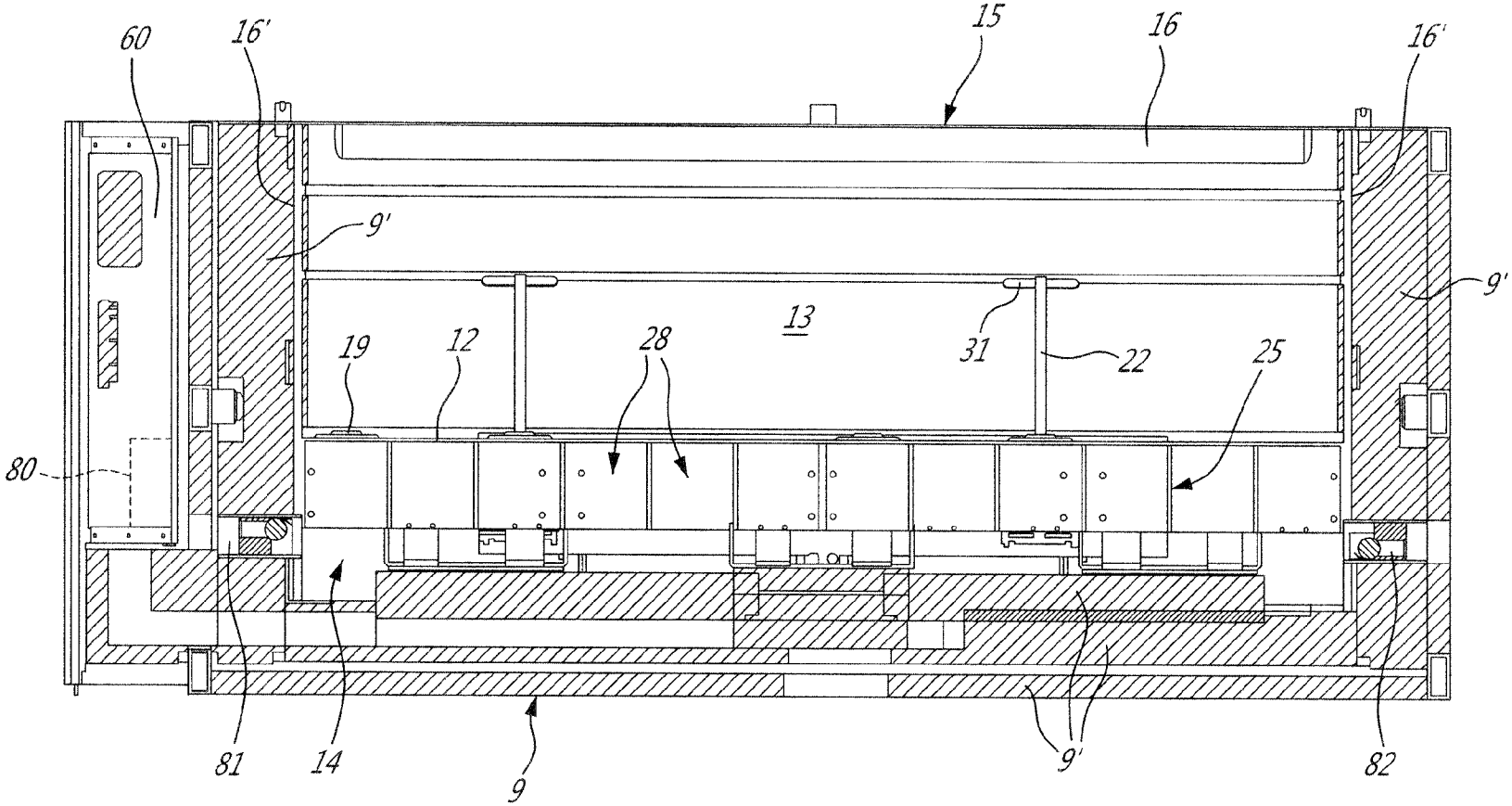
FIG. 6C is a top cross-section view of the housing mounted in the frame with insulation and component parts secured thereto.
Figure 6D:
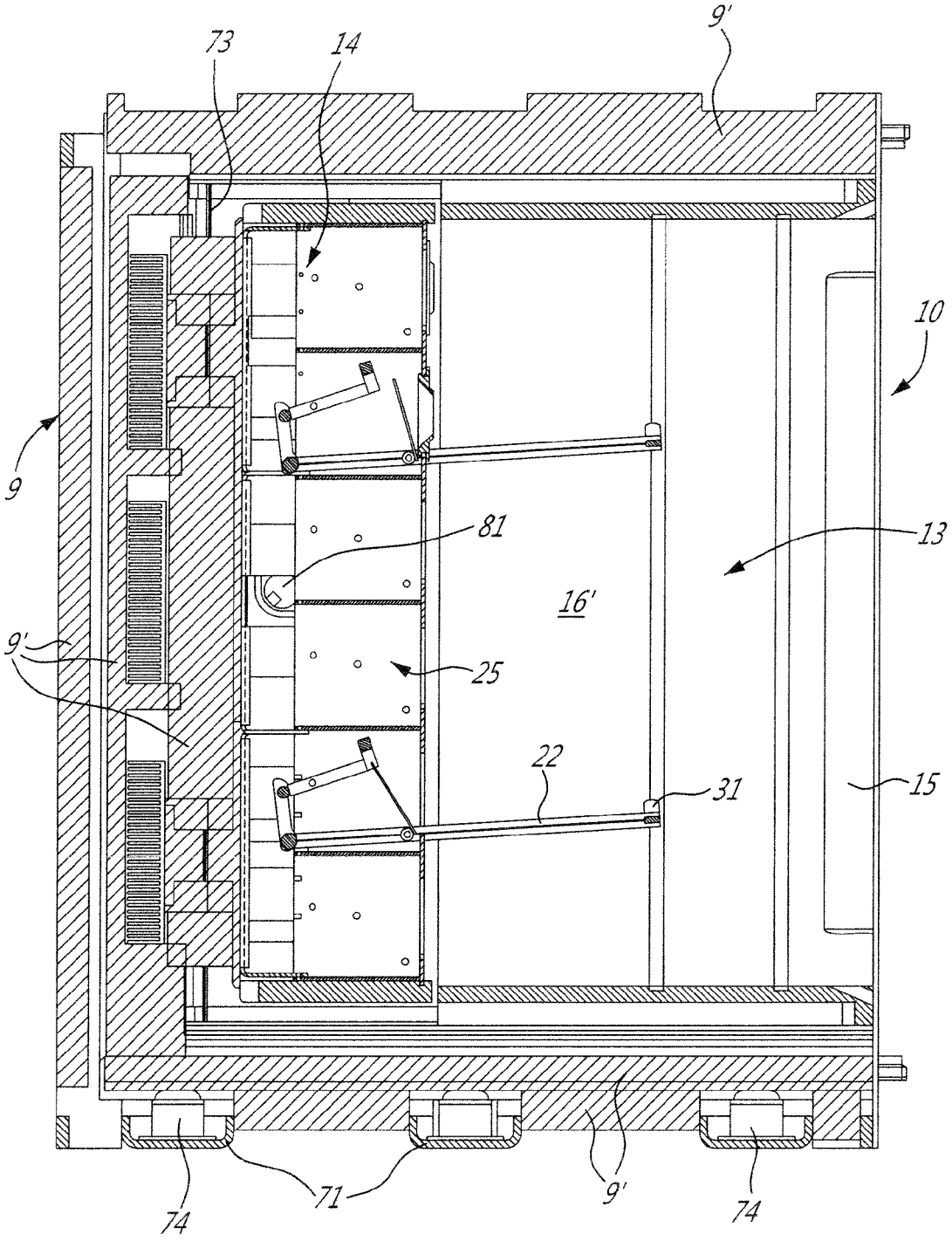
FIG. 6D is a side cross-section view of the housing mounted in the frame and insulation components.
Figure 8:
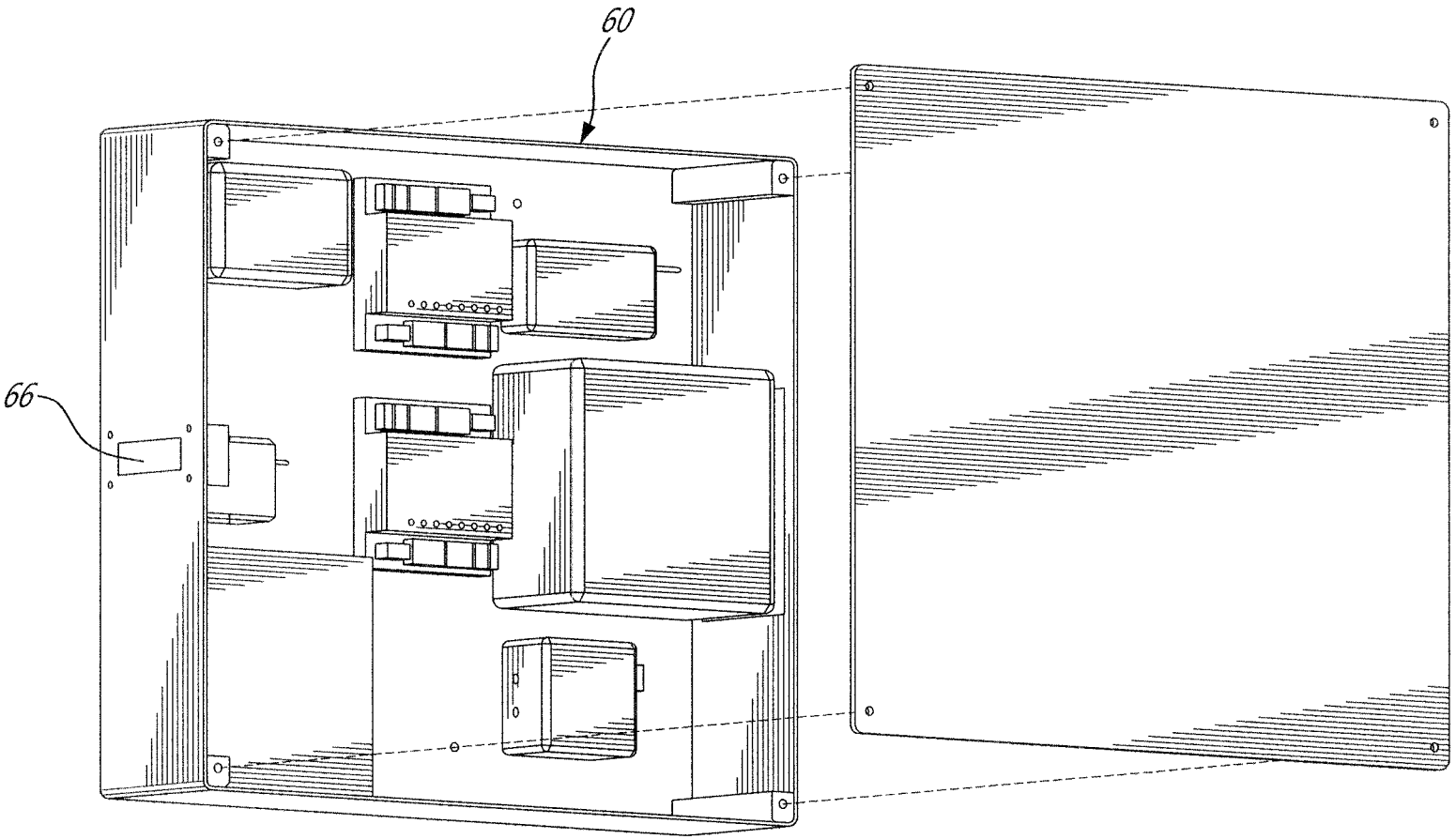
FIG. 8 is a perspective view of the control module.

As further shown in FIGS. 2B and 2C, the cold plates 51 of each of the thermal electric refrigeration modules are directly secured to the horizontal and vertical plates 26 and 27 by thermally conductive metal brackets 55, such as aluminum, and closely spaced behind the cubic chamber structure 25 whereby not to obstruct the spout end portion of the wine bottles. These brackets 55 conduct the cold temperature into the cubic chamber structure. Also, the thermoelectric refrigerating modules 50 and the metal plates 26 and 27 produce condensation on the plates sufficient to produce a humid environment for the preservation of the corks 32'" in the neck portion of the bottles to prevent the corks from drying. This is accomplished, as shown in FIG. 6C, by a fan 80 secured in the control module 70 and positioned close to an entry port 81 in which is secured a ball valve 82 normally biased in a closed position to open to admit a pressured air flow into the rear chamber 14 by causing an exhausting, normally closed, ball valve 82 to open. The ball valves 82 and 82 are secured in a respective one of the opposed insulated side walls 16'. This air flow admits ambient air in the rear chamber which is refrigerated and causing condensation on the plates of the cubic metal structure to produce a humidified environment. A humidity sensing device, not shown herein but obvious to a person skilled in the art, provides signals to a control circuit indicative of the humidity in the rear chamber whereby to control same by operating the fan 80. A temperature sensor is also connected to the controller device 60 as shown in FIG. 8 and which is mounted in the side frame 61 secured to a vibration damping frame 70 as shown in FIG. 6A.

Figure 6E:
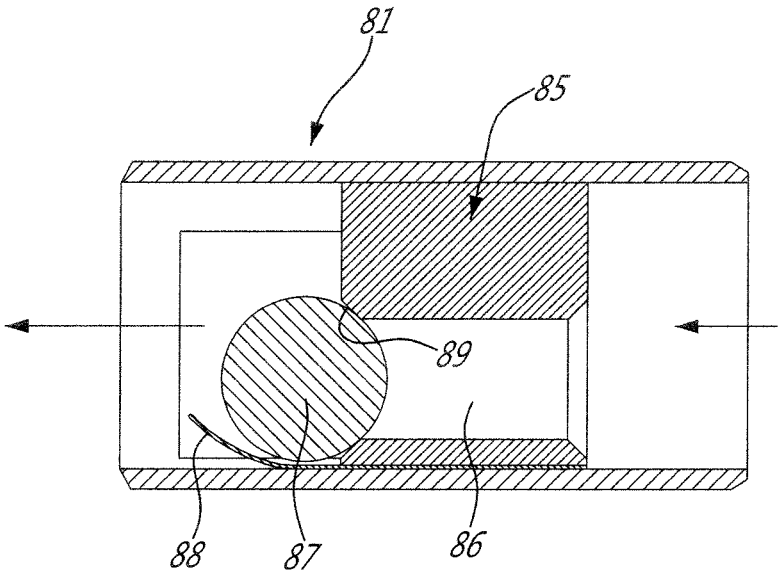
FIG. 6E is an enlarged view of the exit valve of the refrigerated humid air rear chamber.

The ball valves 81 and 82 are illustrated in FIG. 6E and are each comprised by a valve body 85 in which there is defined a venting passage 86 in which there is retained a ball 87 spring-biased by a spring 88 against an annular seating cavity 89 disposed about an pen venting end of the venting passage to close the passage. The spring force of the spring 88 is selected to flex upon a small force applied by the venting flow crated by the fan 80 and sufficient to displace the ball 87 against its eating cavity 89 when the fan is inoperative.

Figure 9:
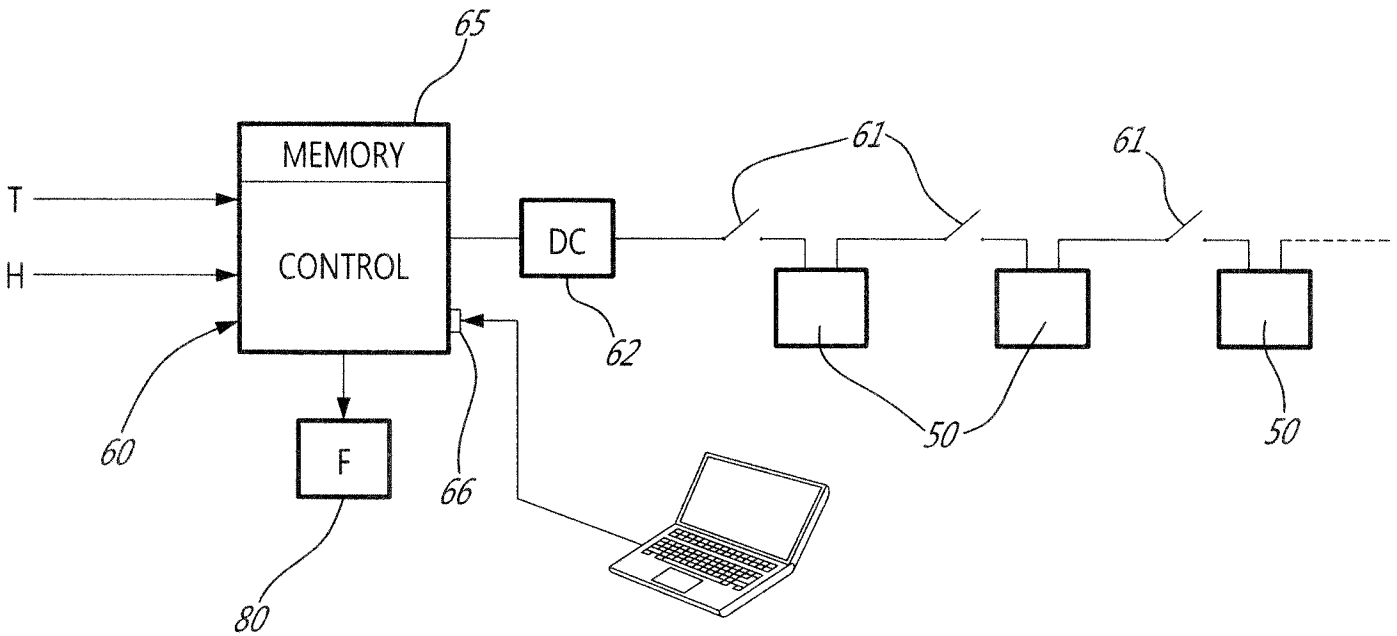
FIG. 9 is a simplified block diagram of the control system.

FIG. 9 is a schematic illustration of the controller device 60 and as hereinshown it controls the thermoelectric devices 50 which are connected in series with one another through independently operable switch means 61, herein schematically illustrated whereby the controller 60 may control the operation of a selected number of these thermoelectric devices depending on the temperature signal received by the thermostatic sensors within the front and rear chambers. This operation of the thermoelectric devices is provided through a DC supply source 62 and closed conditions of the switch 61. The controller device 60 is also a small form-factor computer itself that acts as a Web and application server, able to communicate locally by means of a local are network or distantly by the means of the Internet. Such communications permit user interactions to get information and also change operation parameters without having to activate switches or mechanical devices.

In order to maintain the temperature in the housing 10 at a substantially constant and desired temperature, stone components 69, such as "Valvic" (volcanic lava rock) stone, are secured to the vertical side walls 10' in the front chamber. These stones 69 absorb the cold temperature whereby when the door 15 of the housing is open to insert bottles in the housing or to retrieve bottles from the housing these cold stones will make it possible for the front chamber 13 to quickly recover its set cold temperature. The rear chamber will remain substantially constant due to the cold metallic division wall structure which isolates the front chamber from the rear chamber. Also, the glass bottles and wine which have been refrigerated, help the front chamber to remain in a substantially constant cold state with minimal temperature fluctuation.

Figure 7A:
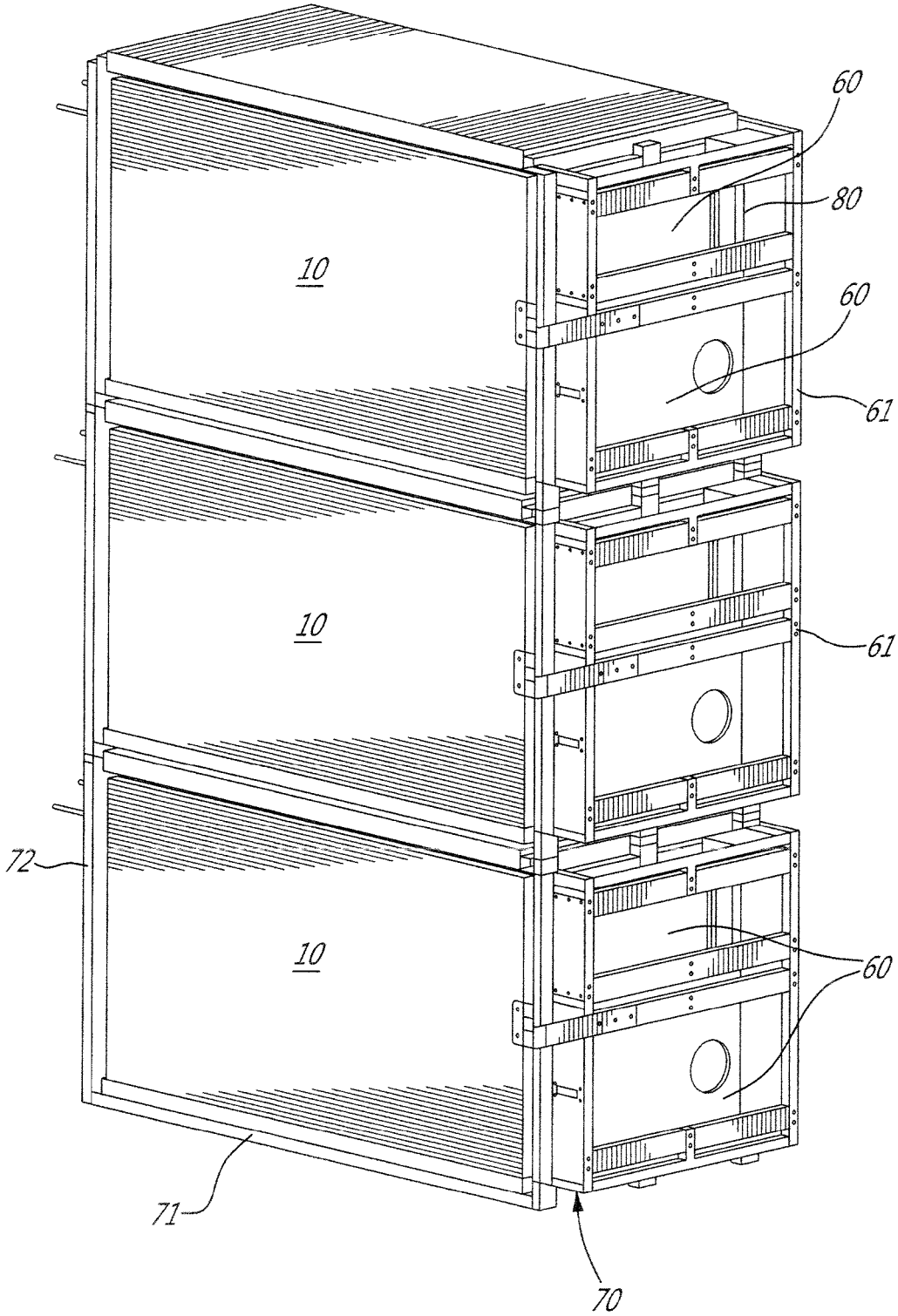
FIG. 7A is a perspective view showing a plurality, herein three frames each containing a temperature and humidity controlled housing constructed in accordance with the present invention and integrated in a modular system.
Figure 7B:
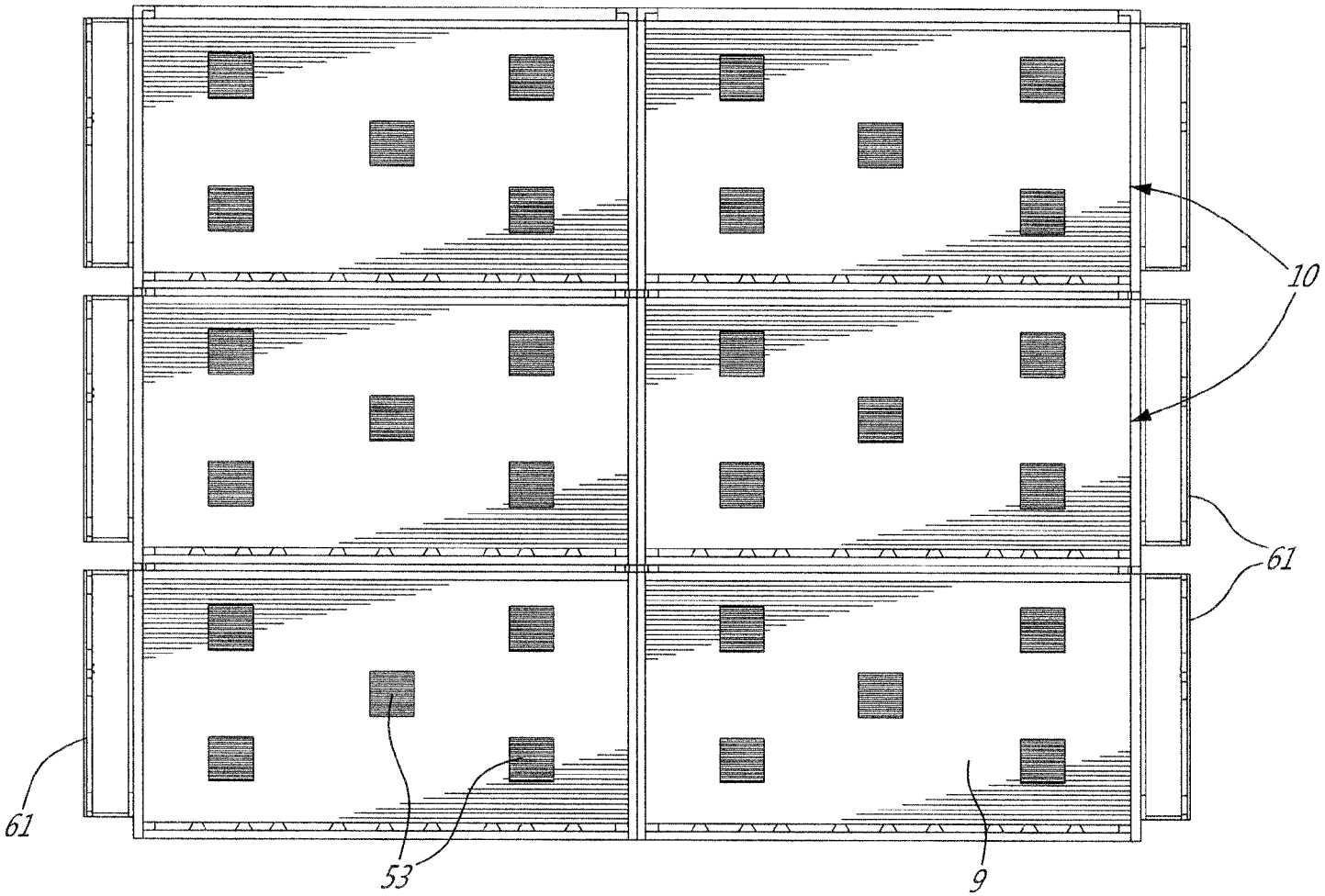
FIG. 7B is a rear view showing six frames with their housings integrated in a modular system.

As previously mentioned, vibrations are not desirable to the preservation of wine. Accordingly, the housing 10 of the present invention is mounted in a vibration damping frame 70 as shown in FIG. 6A. The frame 70 is provided with floor support frame components 71 and opposed side wall frame components 72 interconnected with the floor support frame components 71. A rear brace 73 interconnects the opposed side wall frame components 72. Vibration absorbing members 74 are secured to at least the floor support frame components 71 and as hereinshown are also secured to one of the side frame components 72 whereby any vibration coming from the controller device 70 or other devices such as fans mounted in the side frame 61 are not transmitted into the housing 10. The assembly of the housing in the vibration damping frame 70 constitutes a modular unit and, as shown in FIGS. 7A and 7B, these modular units may be interconnected in stacked vertical relationship. They can also be mounted in side-by-side relationship and to facilitate this, the side frame 61 may be attached to the vibration damping frame 70 either on its left or right side, as shown in FIG. 7B. As shown in the embodiment of FIGS. 1A and 1B, there are seventy-two cubic chambers 28 which define twelve vertical columns of six cubic chambers, thus resulting in a storage capacity for seventy-two wine bottles. However, it is not intended to limit the construction of the housing to this number of cubic chambers as it is contemplated that housing of different dimensions can be constructed.

As also shown in FIG. 1A, the division wall 12 is herein provided with a plurality of LED lamps 80 secured to an adhesive strip 81 adhesively secured to the division wall 12 and facing axially in the direction of the bottles whereby to illuminate the front chamber 13 with a reddish light whose wavelength does not affect the quality of wine contained in the wine bottles. The incident light rays produced by these LEDs are oriented substantially along the longitudinal axis of the wine bottles supported by the support members 21. It has also been found that by pulsating the DC voltage driving the LEDs to a frequency exceeding 70 Hz this prolongs the life of the LEDs and is not visible to the human eye. There may be several strips of LEDs secured to the division wall or on the inner surface of the door frame or at any other convenient location.

With reference to FIGS. 8 and 9, the programmable controller 60 is provided with a memory 65 for storing instructions relating to the operation of the thermoelectric refrigeration devices 50 and thereby controlling the temperature in the front and rear chamber. The controller 60 also controls the humidity in the rear chamber. The memory may also have stored therein a program which identifies each of the bottle supports permitting the identification of wine bottles associated therewith. The programmable controller is so designed as participating in a local are network that is able to communicate with other computers or communication devices by wired or wireless communications, both within the local area network itself and with other computers or communication devices located anywhere in the world by the means of the Internet. In this way, the owner can control and get information from the cellar and all of the wine bottles it contains from anywhere in the world, provided he has access to the Web and the Internet. The micro-computer in the controller device may also have several other functions associated with the housing. The memory may be programmed to retain statistics over long periods of time or advise when a wine bottle is at its peak to be consumed.

It can be seen from the above description of a preferred embodiment of the present invention that there is also provided a method of preserving wine bottles in a temperature and humidity controlled environment. This method comprises the positioning of wine bottles on bottle supports while simultaneously pushing the bottle through a passage having a sealing means with the bottle neck maintaining a seal between the front chamber and the rear chamber with the neck and spout end portion of the bottle being located in the rear chamber which is temperature and humidity controlled thereby preserving the cork of the bottle in a desirable refrigerated and humidified environment. The method also automatically controls thermoelectric refrigeration devices to control the temperature in the front and rear chambers and the humidity in the rear chamber.

It is within the ambit of the present invention to cover any obvious modifications of the preferred embodiment described herein provided such modifications fall within the scope of the appended claims.

The invention claimed is:

1. A temperature and humidity controlled housing for storing and preserving wine bottles, said housing having a storage compartment for supporting a plurality of wine bottles; a division wall in said storage compartment defining a front and a rear chamber, said housing having a door for access to said front chamber for positioning and retrieving wine bottles from individual bottle supports, said bottle supports being secured in relation to an associated one of a plurality of passages formed with said division wall whereby a neck and spout end portion of said wine bottles extend into said rear chamber and a body portion of said wine bottles extends supported in said front chamber, said passages each being provided with displaceable closure means, said displaceable closure means each being provided with a flexible circumferential sealing membrane to substantially isolate said rear chamber from said front chamber and to embrace said neck portion of a wine bottle extending therethrough when disposed on an associated one of said bottle supports from said front chamber, refrigeration means in said rear chamber to refrigerate said storage compartment, a fan in communication with said rear chamber through pressure venting valves associated with a venting passage in said rear chamber communicating said rear chamber to atmosphere when in an open position by pressure created in said rear chamber by said fan, said refrigeration means having one or more cold plates disposed in said rear chamber, said fan creating a regulated ambient air flow in said rear chamber through said pressure venting valves to cause condensation to form on said one or more cold plates, programmable control means to operate said refrigeration means depending on sensed temperature in said storage compartment and humidity conditions of said rear chamber provided by sensors, said programmable control means operating said fan to control the humidity in said rear chamber whereby said spout end of said bottles is maintained in a controlled humidified environment.

2. A temperature and humidity controlled housing as claimed in claim 1 wherein said division wall is a division wall structure having a flat front face facing said front chamber and a cubic chamber structure projecting in said rear chamber, each said cubic chamber being associated with a respective one of said plurality of passages.

3. A temperature and humidity controlled housing as claimed in claim 2 wherein said cubic chamber structure is formed by interconnected spaced-apart horizontal and vertical plates defining therebetween a plurality of said cubic chambers having an open rear end, said individual bottle supports being secured to an associated one of said cubic chambers.

4. A temperature and humidity controlled housing as claimed in claim 3 wherein said horizontal and vertical plates are constructed of thermally conductive material.

5. A temperature and humidity controlled housing as claimed in claim 3 wherein said horizontal and vertical plates define therebetween seventy-two cubic chambers and wherein there are twelve vertical columns of six cubic chambers.

6. A temperature and humidity controlled housing as claimed in claim 1 wherein said displaceable closure means is provided by a plurality of hinge doors each normally biased against a respective one of said plurality of passages on a rear face of said division wall.

7. A temperature and humidity controlled housing as claimed in claim 6 wherein each said hinge doors are spring-biased against said rear face of said division wall by a torsion spring.

8. A temperature and humidity controlled housing as claimed in claim 1 wherein said flexible circumferential sealing membrane is a circular disc membrane having a circular central opening therein.

9. A temperature and humidity controlled housing as claimed in claim 1 wherein said flexible circumferential sealing membrane is a circular disc membrane having slits radiating from a center thereof to constitute flexible tongues adapted to be displaced inwardly from said front face of said division wall when said neck and spout end of said wine bottle is pushed therethrough, said circular disc membrane constituting said displaceable closure means.

10. A temperature and humidity controlled housing as claimed in claim 1 wherein said bottle support is comprised by a body support member pivotal on a horizontal pivot axis extending between opposed side walls of its associated cubic chamber, and an actuable pivoting linkage assembly secured to a counter-lever end of said body support member, said actuable pivoting linkage having a bottle neck clamping lever connected to an actuable linkage to translate an upward pushing force applied by the weight of said bottle inserted in said associated passage and rested substantially horizontally on said body support member to displace said bottle neck clamping lever downwards against said bottle neck, said wine in said bottle contacting entirely a rear face of a cork positioned in said spout end of said wine bottle.

11. A temperature and humidity controlled housing as claimed in claim 10 wherein said bottle neck clamping lever comprises a pair of pivoting spaced-apart side arms pivotally secured to a fixed horizontal pivot rod secured between said opposed side walls, a curved arch member secured between opposed forward ends of said side arms for abutting engagement with said neck portion of said bottle, a linkage arm pivotally connected at a top end to a respective one of opposed rearward ends of said side arms rearwardly of said fixed horizontal pivot rod, said linkage arm being pivotally connected at a bottom end thereof to a respective end of a transverse attachment arm secured to said counter-lever end of said body support member, said transverse attachment arm extending parallel to said horizontal pivot axis and said fixed horizontal pivot rod.

12. A temperature and humidity controlled housing as claimed in claim 10 wherein said body support member is a straight support rod, said horizontal pivot axis being constituted by a transverse fixed pivot rod, and a bottle seating member secured to said support rod for supporting said bottle.

13. A temperature and humidity controlled housing as claimed in claim 12 wherein each said plurality of passages are circular passages defined in said division wall, each circular passage having a curved alignment cavity in a lower edge portion thereof disposed on a vertical radius of said circular passage, said straight support rod resting on said curved alignment cavity.

14. A temperature and humidity controlled housing as claimed in claim 1 wherein said refrigeration means is comprised by at least one thermoelectric refrigeration module.

15. A temperature and humidity controlled housing as claimed in claim 14 wherein there are at least two of said thermoelectric refrigeration modules spaced-apart and secured to said cubic chamber structure behind said open rear end whereby said cold plate of each said thermoelectric refrigeration module will refrigerate said horizontal and vertical plates to accumulate cold and defuse cold air to refrigerate said rear chamber and said front chamber, said division wall being a thermally conductive metal plate.

16. A temperature and humidity controlled housing as claimed in claim 15 wherein said cold plate is secured to at least one of said horizontal and vertical plates by thermally conductive brackets, said thermoelectric refrigeration modules each having a hot plate isolated by an insulation material, a heat sink secured to each said hot plate and disposed in an exposed cavity in an insulating rear wall of said housing to dissipate heat exteriorly of said storage compartment, said cubic chamber also producing condensation in said rear chamber by the creation of said regulated air flow by said fan through said rear chamber.

17. A temperature and humidity controlled housing as claimed in claim 15 wherein said thermoelectric refrigeration modules are connected in series and operative by switch means connected to a DC supply.

18. A temperature and humidity controlled housing as claimed in claim 1 wherein said pressure venting valves are ball valves normally biased in a closed position against said venting passage in communication with said rear chamber, and biasing means to bias a displaceable ball of said ball valve against a seating cavity about an open venting end of said venting passage.

19. A temperature and humidity controlled housing as claimed in claim 1 wherein said front chamber is provided with a stone tile on at least one of surrounding walls thereof to store cold to quickly maintain said front chamber at a substantially predetermined temperature after said door has been opened and closed, said front chamber being isolated from said rear chamber to prevent ingress of humidity from said rear chamber to prevent the formation of mould on labels adhesively secured to said bottle body disposed in said front chamber.

20. A temperature and humidity controlled housing as claimed in claim 1 wherein said housing is secured in a vibration damping frame, said vibration damping frame having floor support frame members and opposed side wall frame members interconnected with said floor support frame members, and a rear brace interconnecting said opposed side wall frame members, and vibration absorbing components secured to at least said floor support frame members.

21. A temperature and humidity controlled housing as claimed in claim 1 wherein said housing is mounted in a support frame, said support frame permitting stacking of two or more of said housings in at least one of a side-by-side and vertically stacked relationship.

22. A temperature and humidity controlled housing as claimed in claim 21 wherein said vibration damping frame has a plurality of vibration absorbing components supporting said housing.

23. A temperature and humidity controlled housing as claimed in claim 1 wherein said door is a double thickness glass door having a light filter capable of conducting exterior light of a wavelength which does not affect the quality of wine contained in said wine bottles.

24. A temperature and humidity controlled housing as claimed in claim 1 wherein said front chamber is provided with a red light emitting source having its incident light rays oriented substantially along a longitudinal axis of said wine bottles supported in said housing.

25. A temperature and humidity controlled housing as claimed in claim 24 wherein said red light emitting source is provided by electro-luminescence light emitting diodes (LEDs).

26. A temperature and humidity controlled housing as claimed in claim 25 wherein said LEDs are secured on at least one of said division wall or inner door frame, said LEDs being pulsated at a frequency exceeding 70 Hz which is not visible to the human eye.

27. A temperature and humidity controlled housing as claimed in claim 1 wherein said programmable control means has a memory for storing instructions relating to the operation of said refrigeration means, said fan and humidity sensed of said rear chamber, each said bottle supports having an identification code incorporated in a program to identify wine bottles associated therewith and having a description inputted by a user person, and means to input and access information pertaining to said wine bottles stored in said housing.

28. A method of preserving wine bottles in a temperature and humidity controlled housing comprising:

i) providing a housing defining a storage compartment for supporting a plurality of wine bottles at a specific orientation, ii) dividing said housing by a division wall to define a refrigerated front chamber and a substantially isolated refrigerated and humidified rear chamber, said division wall having a plurality of passages provided with displaceable closure means, bottle supports being secured in relation to an associated one of said passages, iii) positioning wine bottles on each said bottle support by pushing a neck and spout and portion of said wine bottles into said rear chamber through said displaceable closure means of said passages to establish a substantially sealed relationship between said neck and spout end portion and said passages, iv) refrigerating said storage compartment by refrigeration means having one ore more cold plates disposed in said rear chamber, v) controlling humidity in said rear chamber by operating a fan to introduce ambient air in said rear chamber and simultaneously exhausting air therefrom through venting valves, vi) causing condensation to form on said one ore more cold plates in said rear chamber behind said division wall, and vii) automatically controlling said refrigeration means and said fan modules by means of an automatic controller to control the temperature in said front and rear chambers and the humidity in said rear chamber whereby to maintain a cork in said wine bottle in a humid environment.

29. A method as claimed in claim 28 wherein there is further provided means to input and access stored information in a memory of said automatic controller pertaining to the identification of wine bottles in association with said passages.

* * * * *